US009388765B2

(12) United States Patent
Kurita et al.

(10) Patent No.: US 9,388,765 B2
(45) Date of Patent: Jul. 12, 2016

(54) INTERNAL COMBUSTION ENGINE AND STRUCTURE OF CHAIN COVER OF THE SAME

(71) Applicant: AISIN SEIKI KABUSHIKI KAISHA, Kariya-shi (JP)

(72) Inventors: Hirotaka Kurita, Nagoya (JP); Yoshiharu Takeda, Kariya (JP); Yoshiyuki Kawai, Nagoya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/503,866

(22) Filed: Oct. 1, 2014

(65) Prior Publication Data

US 2015/0096526 A1 Apr. 9, 2015

(30) Foreign Application Priority Data

Oct. 4, 2013 (JP) ..... 2013-209162
Jan. 29, 2014 (JP) ..... 2014-014274

(51) Int. Cl.
*F02F 7/00* (2006.01)
*F02F 11/00* (2006.01)

(52) U.S. Cl.
CPC ..... *F02F 7/008* (2013.01); *F02F 7/0073* (2013.01); *F02F 11/00* (2013.01); *F02F 11/007* (2013.01); *F02F 2007/0078* (2013.01)

(58) Field of Classification Search
CPC ..... F02F 7/0053; F02F 7/0021; F02F 7/00; F02F 7/0068; F02F 1/20; F02F 2007/0041; F02F 11/00; F02F 2007/0078; F02F 7/0046; F02F 7/0065; F01M 11/00
USPC ..... 123/195 C, 195 R, 195 A, 195 P, 195 S, 123/195 H, 196 R; 277/590, 591, 593, 595
See application file for complete search history.

(56) References Cited

U.S. PATENT DOCUMENTS 4,261,310 A * 4/1981 Laws, Jr. ..... F02B 75/22 123/198 E
4,480,609 A 11/1984 Hayashi
4,607,601 A 8/1986 Kohler
(Continued)

FOREIGN PATENT DOCUMENTS

EP 0 600 341 A1 6/1994
JP 2006-242138 A 9/2006
(Continued)

OTHER PUBLICATIONS

European Search Report issued on Mar. 5, 2015, by the European Patent Office, in corresponding European Patent Application No. 14187035 (5 pages).

*Primary Examiner* — Lindsay Low
*Assistant Examiner* — Long T Tran
(74) *Attorney, Agent, or Firm* — Buchanan Ingersoll & Rooney PC

(57) ABSTRACT

An internal combustion engine includes: a chain cover that is attached to an internal combustion engine main body having a crankshaft; an oil seal that is mounted on the crankshaft in the vicinity of the chain cover; a metallic oil seal fixing member that is disposed on a surface of the chain cover and fixes the oil seal, the surface being present opposite to the internal combustion engine main body; and a first sealing member that is disposed between the oil sealing fixing member and the chain cover.

13 Claims, 20 Drawing Sheets

(56) References Cited

U.S. PATENT DOCUMENTS

| | | | | |
|---|---|---|---|---|
| 5,000,142 | A * | 3/1991 | Aruga | F01M 1/02 123/195 C |
| 5,645,024 | A | 7/1997 | Allen et al. | |
| 6,308,673 | B1 * | 10/2001 | Kobayashi | F01L 1/02 123/195 C |
| 6,752,119 | B2 * | 6/2004 | Coleman | F01L 1/02 123/195 C |
| 2003/0051695 | A1 | 3/2003 | Coleman | |
| 2007/0235262 | A1 * | 10/2007 | Takahashi | F01M 1/08 184/6.5 |
| 2008/0093186 | A1 | 4/2008 | Imai et al. | |
| 2011/0278803 | A1 * | 11/2011 | Yamazaki | F16J 15/14 277/654 |
| 2012/0091665 | A1 * | 4/2012 | Okuda | F16J 5/3224 277/573 |
| 2014/0137833 | A1 | 5/2014 | Buehler et al. | |

FOREIGN PATENT DOCUMENTS

| | | | |
|---|---|---|---|
| JP | 2008-106809 | A | 5/2008 |
| JP | 2010-032021 | A | 2/2010 |

* cited by examiner (FIRST EMBODIMENT)

(MODIFICATION EXAMPLE OF FIRST EMBODIMENT)

(SECOND EMBODIMENT)

(BACK SURFACE SIDE)

(THIRD EMBODIMENT)

(FOURTH EMBODIMENT)

(FIFTH EMBODIMENT)

(SIXTH EMBODIMENT)
(BACK SURFACE SIDE)

(SEVENTH EMBODIMENT)

(EIGHTH EMBODIMENT)

INTERNAL COMBUSTION ENGINE AND STRUCTURE OF CHAIN COVER OF THE SAME

CROSS REFERENCE TO RELATED APPLICATIONS

This application is based on and claims priority under 35 U.S.C. §119 to Japanese Patent Applications 2013-209162 and 2014-014274, filed on Oct. 4, 2013 and Jan. 29, 2014, respectively, the entire contents of which are incorporated herein by reference.

TECHNICAL FIELD

This disclosure relates to an internal combustion engine and the structure of a chain cover of the internal combustion engine, in particular, to an internal combustion engine and the structure of a chain cover of the internal combustion engine that includes the chain cover attached to an internal combustion engine main body and a metallic oil seal fixing member for fixing an oil seal mounted on a crankshaft.

The related art discloses an internal combustion engine that includes a chain cover attached to an internal combustion engine main body and a metallic oil seal fixing member for fixing an oil seal mounted on a crankshaft (for example, refer to JP 2010-32021A (Reference 1)).

Reference 1 discloses the internal combustion engine which includes a resin-made timing chain cover attached to a cylinder block (the internal combustion engine main body); the oil seal that is press-fitted into (mounted on) the crankshaft; and a metallic retainer (the oil seal fixing member) that holds the oil seal while being fitted into an insertion hole for the crankshaft from a direction of the cylinder block (from an inner side), the insertion hole for the crankshaft being formed in the timing chain cover, and the structure of the oil seal of the internal combustion engine. In the structure of the oil seal of the internal combustion engine disclosed in Reference 1, in a state where the oil seal and the metallic retainer are inserted into the crankshaft extending from the cylinder block, the metallic retainer is disposed across a side surface of the cylinder block, and an outer side (positioned opposite to the cylinder block) of the metallic retainer is covered with the timing chain cover. The outer resin-made timing chain cover (positioned opposite to the cylinder block) and the metallic retainer are jointly tightened and fixed to the cylinder block, using bolts. The metallic retainer has a flange portion (with a stepped structure) that can be fitted around the crankshaft, and the retainer and the timing chain cover are tightly joined and fixed in a state where an inner flange portion of the metallic retainer is fitted into a stepped hole of the outer timing chain cover.

BACKGROUND DISCUSSION

However, in the structure of the oil seal of the internal combustion engine disclosed in Reference 1, oil in a portion of the cylinder block (the internal combustion engine main body) is sealed at a portion that is provided with the oil seal, and in contrast, the oil in the cylinder block may leak to the outside via a slight gap occurring in a fitting portion in the vicinity of the crankshaft, in which the metallic retainer (the oil seal fixing member) and the resin-made timing chain cover are fitted into each other. For this reason, there is a problem in satisfactorily sealing the oil.

SUMMARY

Thus, a need exists for an internal combustion engine and the structure of a chain cover of the internal combustion engine which are not suspectable to the drawback mentioned above.

An internal combustion engine according to an aspect of this disclosure includes a chain cover that is attached to an internal combustion engine main body having a crankshaft; an oil seal that is mounted on the crankshaft in the vicinity of the chain cover; a metallic oil seal fixing member that is disposed on a surface of the chain cover, the surface being present opposite to the internal combustion engine main body, and fixes the oil seal; and a first sealing member that is disposed between the oil sealing fixing member and the chain cover.

According to the aspect of this disclosure, as described above, since the internal combustion engine includes the chain cover that is attached to the internal combustion engine main body; and the metallic oil seal fixing member that is disposed on the surface of the chain cover and fixes the oil seal, the surface being present opposite to the internal combustion engine main body, and the first sealing member is provided between the oil seal fixing member and the chain cover, in the structure of the chain cover in which the chain cover is attached to the internal combustion engine main body, and the oil seal fixing member is disposed on an outer surface of the chain cover, the first sealing member provided between the chain cover and the oil seal fixing member is squeezed, and thus it is possible to bring the first sealing member into close contact with the respective facing surfaces of the chain cover and the oil seal fixing member. Accordingly, oil in the internal combustion engine main body can be sealed around a portion of the crankshaft, the portion being provided with the oil seal, and it is possible to prevent the oil in the internal combustion engine main body from leaking to the outside via a gap in which the chain cover and the oil seal fixing member overlap with each other, using the sealing function of the first sealing member. As a result, even when the oil seal is mounted on the crankshaft via the oil seal fixing member formed separately from the chain cover, it is possible to secure sealing properties between the chain cover and the oil seal fixing member.

According to the aspect of this closure, as described above, even when an oil seal is mounted on a crankshaft via an oil seal fixing member formed separately from a chain cover, it is possible to provide an internal combustion engine and the structure of the chain cover of the internal combustion engine in which sealing properties between the chain cover and the oil seal fixing member can be secured.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, embodiments disclosed here will be described with reference to the accompanying drawings.

First Embodiment

Figure 1:
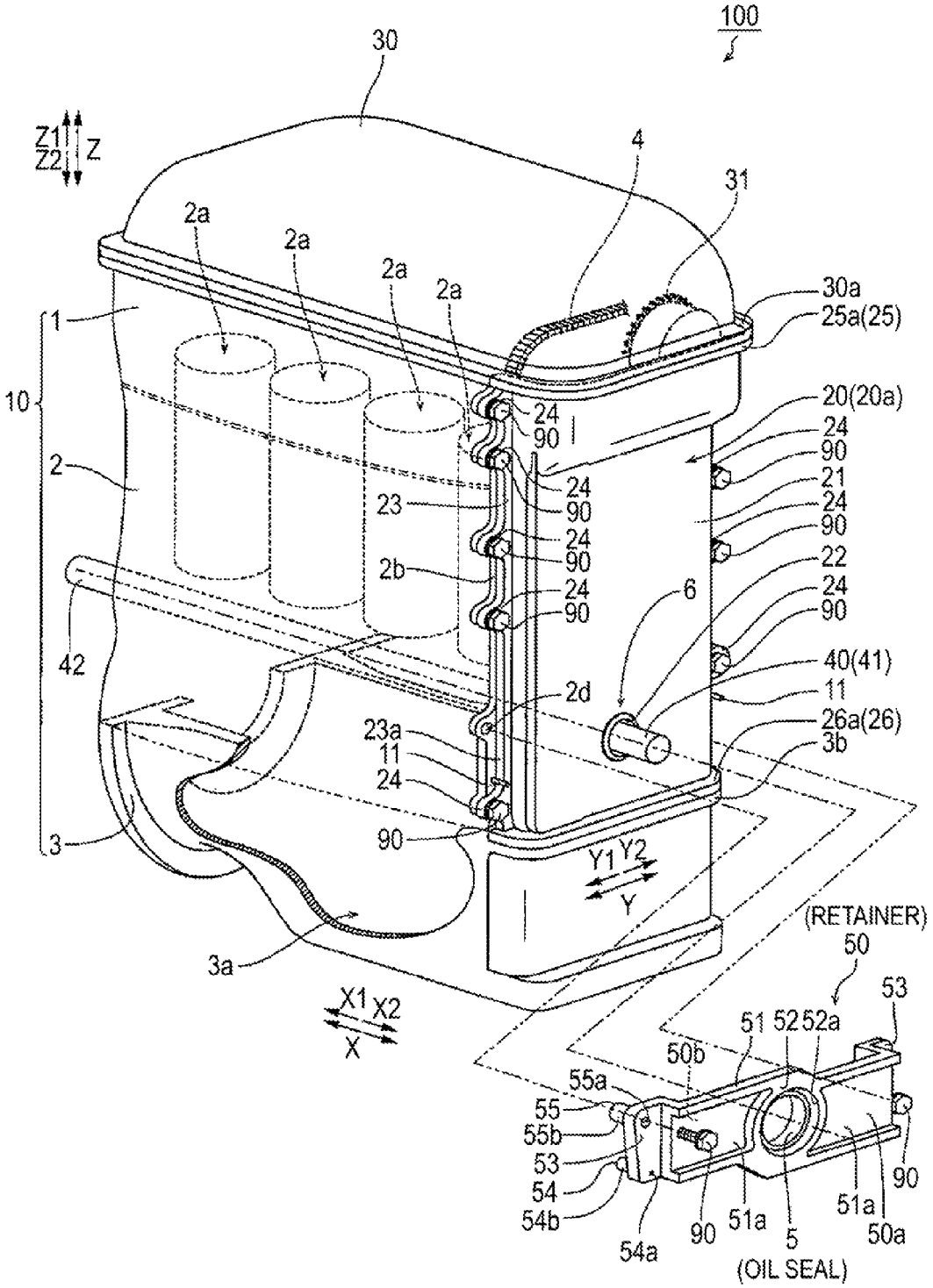
FIG. 1 is a perspective view illustrating a schematic configuration of an engine according to a first embodiment disclosed here.

First, the configuration of an engine 100 according to a first embodiment disclosed here will be described with reference to FIGS. 1 to 6. In FIG. 1, reference signs are assigned to main configuration elements of the engine 100, respectively, and in FIGS. 2 to 6, reference signs are assigned to detailed configurations (structures) around a timing chain cover 20. In the following description of the engine 100, an X direction (a longitudinal direction) refers to an extension direction of a crankshaft 40, a Y direction (a lateral direction) refers to a perpendicular direction of the crankshaft 40, and a Z direction (a vertical direction) refers to an extension direction of cylinders 2*a*.

As illustrated in FIG. 1, according to the first embodiment disclosed here, the engine 100 for a vehicle includes an engine main body 10 made of aluminum alloy which has a cylinder head 1; a cylinder block 2; and a crankcase 3. The gasoline engine 100 includes the timing chain cover 20 (hereinafter, referred to as the TCC 20) made of resin, for example, nylon 66 which is assembled to a side end portion (an edge portion 2*b*) of the engine main body 10 on an X2 side, and which covers a timing chain 4; and a resin-made head cover 30 that is assembled to an upper side (a Z1 side) of the cylinder head 1. The engine 100 is an example of an "internal combustion engine" in the embodiment disclosed here, and the timing chain cover (TCC) 20 is an example of a "chain cover" in the embodiment disclosed here.

A camshaft (not illustrated), a valve mechanism (not illustrated) and the like are disposed in the cylinder head 1. The cylinders 2*a* (illustrated by a dotted line) are formed in the cylinder block 2 connected to a lower portion (a portion on a Z2 side) of the cylinder head 1, and pistons (not illustrated) reciprocate in the cylinders 2*a* in the Z direction, respectively. An intake device (not illustrated) is connected to the cylinder head 1, and introduces intake air into a plurality of (four) cylinders 2*a* formed in the cylinder block 2. A crankshaft 40 is disposed in a crankcase 3 connected to a lower portion (a portion on the Z2 side) of the cylinder block 2, and is rotatably connected via the pistons and connecting rods. FIG. 1 illustrates the crankshaft 40 with a substantially bar shape, but in practice, the crankshaft 40 has a configuration in which each of crankpins and balance weights interposing the crankpin therebetween are connected to crank journals, and the crankpins with an eccentric rotary shaft are respectively disposed directly below the cylinders 2*a*.

A lower portion (a portion on the Z2 side) of the crankcase 3 is provided with an oil reservoir 3*a* in which engine oil is stored. After the engine oil is drawn up from the oil reservoir 3*a* to an upper portion of the engine main body 10 by an oil pump (not illustrated), and lubricates sliding portions such as an outer circumferential surface of the camshaft, the respective outer circumferential surfaces of the pistons, and the like, the engine oil falls due to its own weight and returns to the oil reservoir 3*a*.

Figure 2:
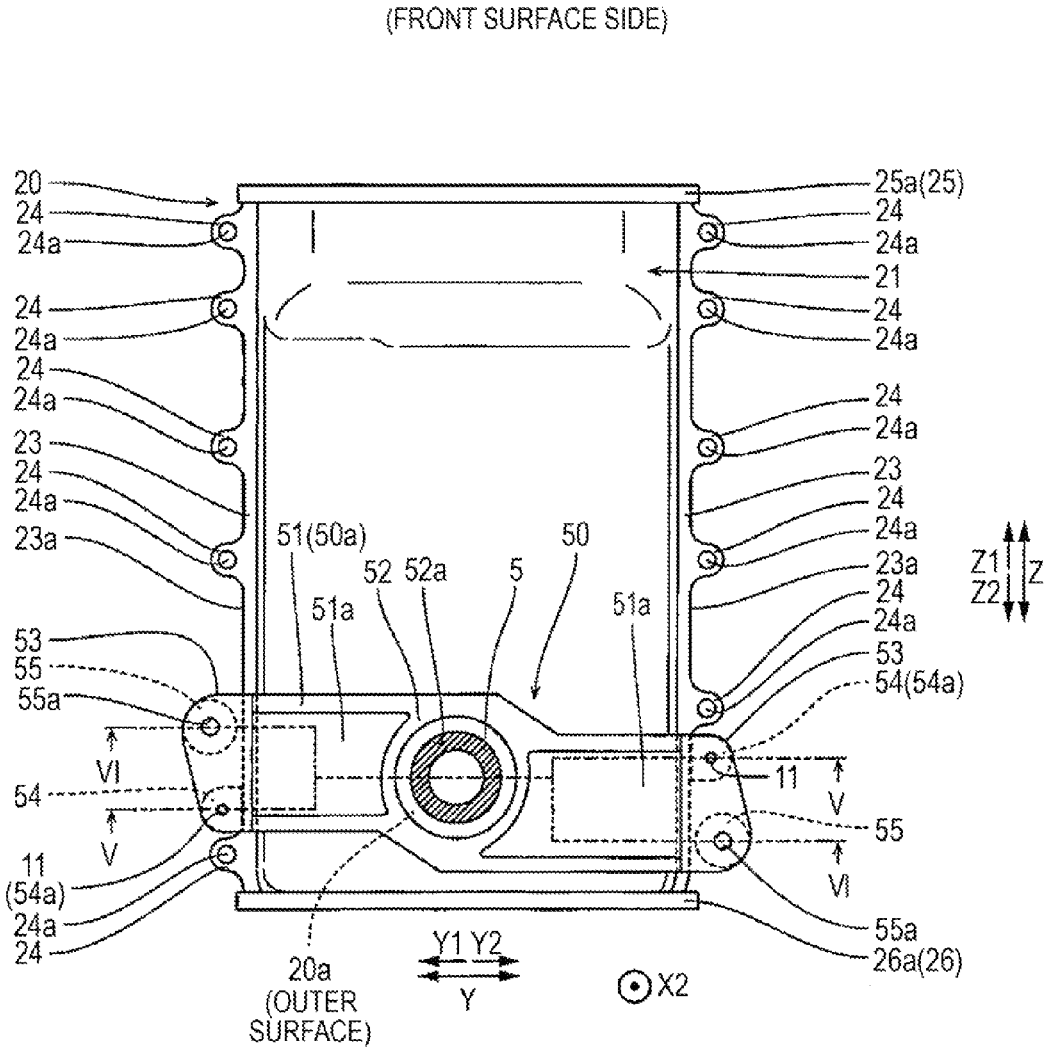
FIG. 2 is a side view illustrating a state where a retainer is assembled to a timing chain cover from the outside in the engine according to the first embodiment disclosed here.

As illustrated in FIG. 2, the TCC 20 has a planar shape that corresponds to a side cross-sectional shape of the engine main body 10 (refer to FIG. 1) on the X2 side. A boss portion 22 (refer to FIG. 3) is formed to have a through hole 22*a* in a lower portion (a portion on the Z2 side) and in the vicinity of a center portion of a main body portion 21 in the Y direction. The through hole 22*a* passes through the main body portion 21 in a thickness direction (the X direction) of the main body portion 21, and a front end portion 41 of the crankshaft 40 (refer to FIG. 1) on the X2 side is inserted into the through hole 22*a*. The TCC 20 has a pair of end portions 23 that are disposed in directions (Y1 and Y2 directions) opposite to each other, with the through hole 22*a* being centered between the end portions 23. Each of the end portions 23 is provided with boss portions 24, each of which has a through hole 24*a* and is formed integrally with the main body portion 21. Five boss portions 24 are formed in each of the end portions 23, and the through hole 24*a* passes through each of the end portions 23 in a thickness direction (X direction) of the end portions 23. FIG. 2 illustrates a two-dimensional state in which a retainer 50 (to be described later) is disposed with respect to the TCC 20, and does not illustrate the cylinder block 2 that is present rearward (on a rear side of the drawing sheet) of the TCC 20. The Y direction (Y1 and Y2 directions) is an example of a "second direction" in the embodiment disclosed here.

An end portion 25 is provided on the Z1 side (an upper side) of the TCC 20, and a lower end portion 26 is provided on the Z2 side (a lower side) of the TCC 20. Here, as illustrated in FIG. 1, a flange 25*a* is provided in the end portion 25 in which a cross section of the main body portion 21 is opened upwards. The TCC 20 and the head cover 30 are connected to each other using bolts (not illustrated) with the flange 25*a* facing a flange 30*a* of the head cover 30 upwards.

A flange 26*a* is provided in the end portion 26 in which a cross section of the main body portion 21 is opened downwards. The TCC 20 and the crankcase 3 are connected to each other using bolts (not illustrated) with the flange 26*a* facing a flange 3*b* of the crankcase 3 downwards.

Figure 3:
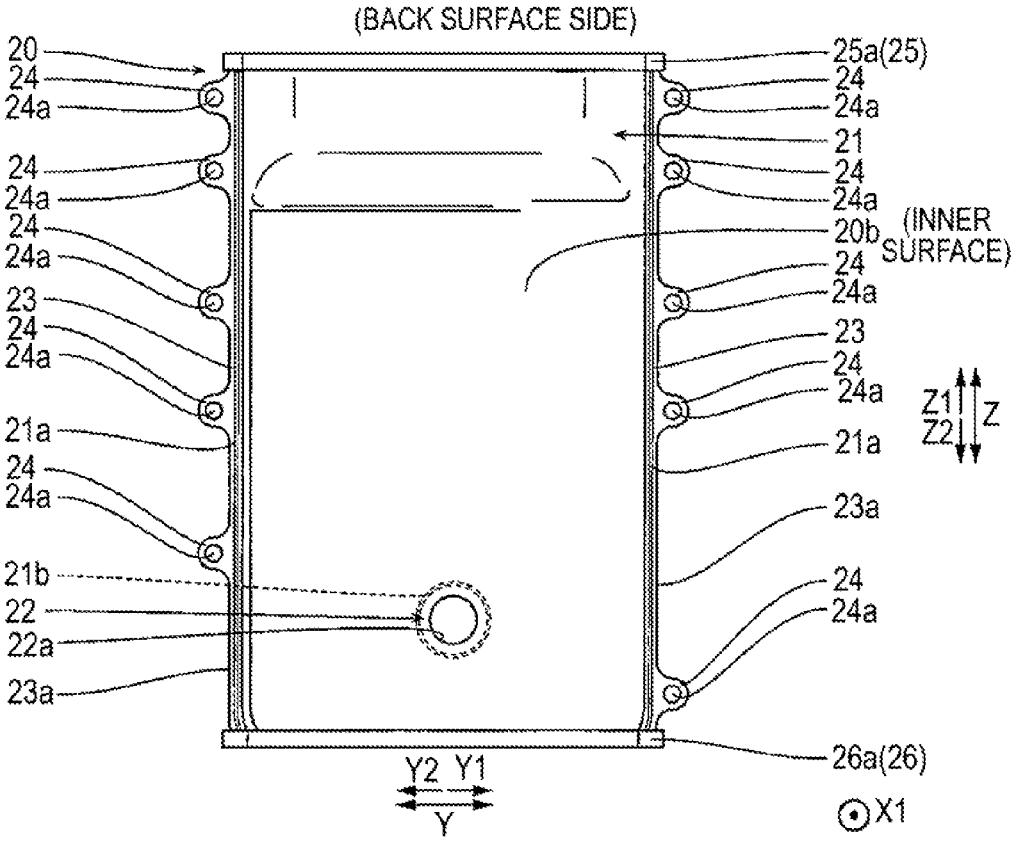
FIG. 3 is a plan view of the chain cover in the engine according to the first embodiment disclosed here, when a back surface (a surface attached to an engine main body) of the chain cover is seen.

When a back surface (a surface to which the cylinder block 2 (refer to FIG. 1) is attached) of only the TCC 20 is seen in an arrow X2 direction, as illustrated in FIG. 3, groove portions 21*a* are respectively formed in the pair of end portions 23 that extend in the Z direction. Sealing member 7 (to be described later) (refer to FIG. 5) are respectively fitted into the groove portions 21*a*. As illustrated in FIG. 1, in a state where the front end portion 41 of the crankshaft 40 on the X2 side is inserted into the through hole 22*a*, the TCC 20 is attached to a side portion (the edge portion 2*b* of the cylinder block 2) of the engine main body 10, using bolts 90.

Figure 5:
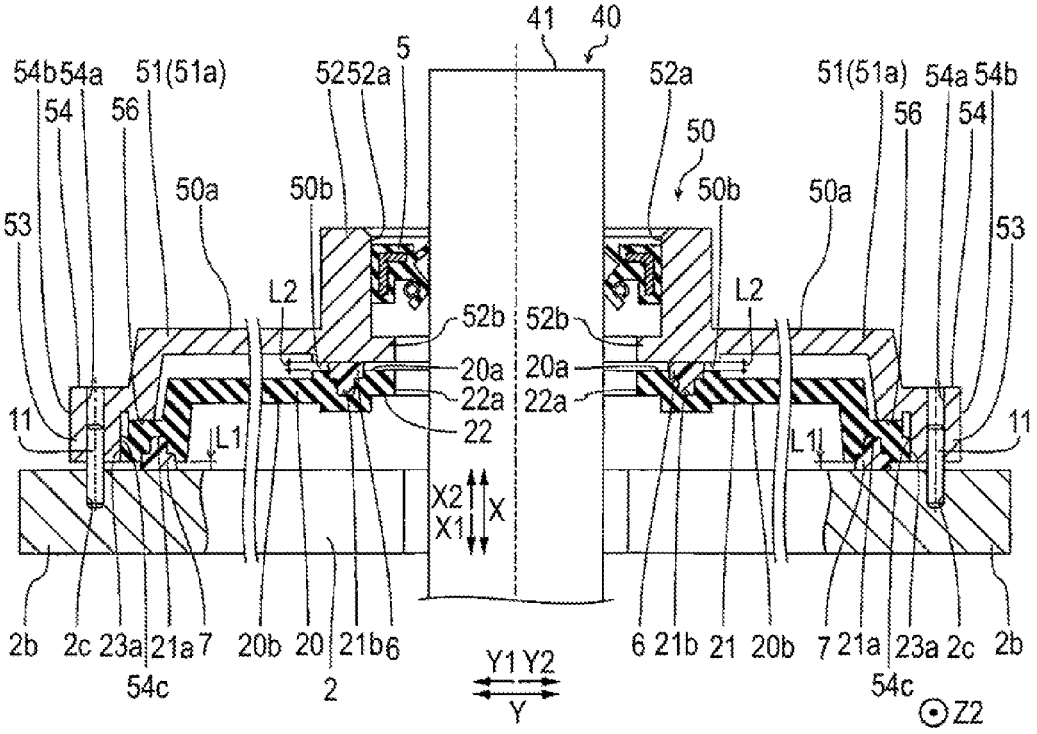
FIG. 5 is a cross-sectional view taken along line V-V in FIG. 2.
Figure 6:
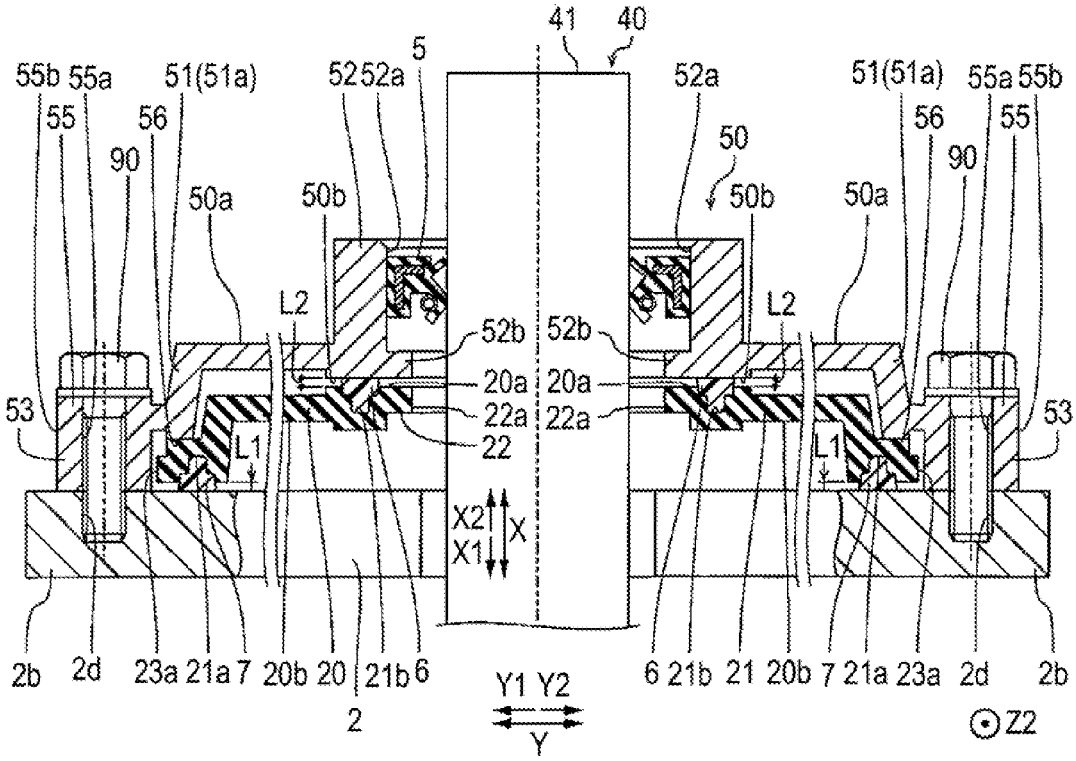
FIG. 6 is a cross-sectional view taken along line VI-VI in FIG. 2.

Here, in the first embodiment, as illustrated in FIGS. 5 and 6, an oil seal 5 is mounted on a portion of the crankshaft 40, the portion corresponding to the through hole 22*a* of the TCC 20. The oil seal 5 is not necessarily held only by the TCC 20 in a state where an outer circumferential portion of the oil seal 5 is directly fitted to an inner circumferential surface of the through hole 22*a* of the TCC 20, but is also held by the retainer 50 which is made of aluminum alloy. The retainer 50 having a predetermined attachment structure is attached to the engine main body 10, and thus the oil seal 5 is mounted on the crankshaft 40 in the vicinity of the TCC 20. The oil seal 5 prevents oil in the crankcase 3 (refer to FIG. 1) from leaking to the outside of the engine main body 10 (refer to FIG. 1) around the crankshaft 40. The retainer 50 is an example of an "oil seal fixing member" in the embodiment disclosed here.

Hereinafter, the attachment structure of the retainer 50 being attached to the engine main body 10 for holding the oil seal 5 will be described in detail.

Figure 4:
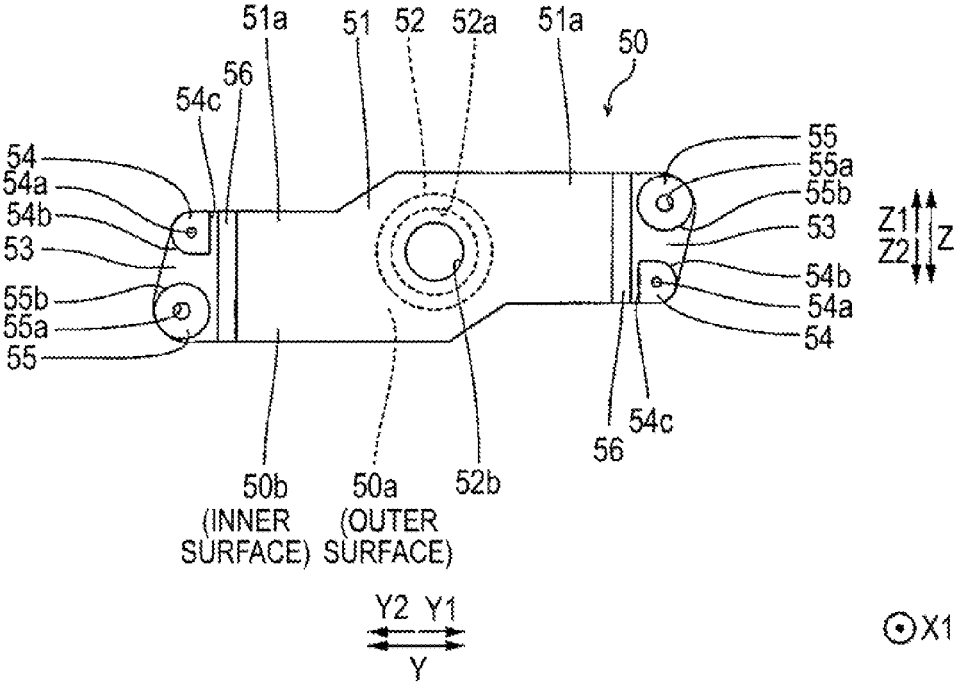
FIG. 4 is a plan view of the retainer for holding an oil seal in the engine according to the first embodiment disclosed here, when a back surface (a surface attached to an engine main body) of the retainer is seen.

As illustrated in FIGS. 1 and 4, a boss portion 52 is formed in the retainer 50, and has a through hole 52*a* in a center portion of a main body portion 51 that extends in the Y direction. The through hole 52*a* passes through the main body portion 51 in a thickness direction (the X direction) of the main body portion 51, and the front end portion 41 (refer to FIG. 1) of the crankshaft 40 is inserted into the through hole 52*a*. In a cross-sectional structure of the retainer 50 illustrated in FIG. 5, an annular-shaped stopping portion 52*b* is formed on an inner circumferential surface of the through hole 52*a* of the boss portion 52, and protrudes along the Y direction so as to decrease an inner diameter of the through hole 52*a*. The oil seal 5 is fixed to the through hole 52*a* in a state where the oil seal 5 is press-fitted into the through hole 52*a* from the outside (the X2 side) toward the inside (the X1 side). The stopping portion 52*b* prevents the press-fitted oil seal 5 from excessively slipping toward the cylinder block 2.

As illustrated in FIG. 4, when a back surface (an inner surface 50*b* opposite to an outer surface 50*a*) of the retainer 50 is seen, the retainer 50 has a pair of end portions 53 that are respectively formed at the respective tips of arm portions 51*a* extending in directions (Y1 and Y2 directions) opposite to each other, with the through hole 52*a* being centered between the arm portions 51*a*. The boss portions 54 and 55 are provided in each of the end portions 53 so as to be adjacent to each other in the Z direction. The boss portion 54 has an attachment hole 54*a* with a smooth inner circumferential surface, and the boss portion 55 has an attachment hole 55*a* with a smooth inner circumferential surface. At this time, in the respective end portions 53 on the Y1 and Y2 sides, the sequence of disposing the boss portions 54 and 55 in the Z direction is reversed. The attachment holes 54*a* and 55*a* pass through the main body portion 51 in the thickness direction (X direction). The boss portions 54 and 55 are formed integrally with the main body portion 51. The boss portion 54 is an example of a "first positioning portion" and an "attachment boss" in the embodiment disclosed here. The attachment hole 54*a* is an example of a "positioning hole" in the embodiment disclosed here.

Accordingly, as illustrated in FIG. 1, in the engine 100, in a state where the TCC 20 is attached to the engine main body 10 (the cylinder block 2) along the edge portion 2*b* on a front side (the X2 side) of the engine main body 10, using the bolts 90, the retainer 50 is attached to the TCC 20 from the front side in the X1 direction so as to span an outer surface 20*a* in a portion of the TCC 20 in the Y direction, the portion corresponding to the crankshaft 40 that protrudes outward from the through hole 22*a*.

As illustrated in FIG. 5, a knock pin 11 is fixed to a portion of the edge portion 2*b* of the cylinder block 2, the portion corresponding to the end portion 53 of the retainer 50, and a part of the knock pin 11 protrudes in the X2 direction. The knock pins 11 of a ferrous metallic material are respectively press-fitted into fixing holes 2*c* by a predetermined depth, and the fixing holes 2*c* are respectively provided in the respective edge portions 2*b* of the cylinder block 2 on the Y1 and Y2 sides. The knock pin 11 has an outer diameter slightly smaller than an inner diameter of the attachment hole 54*a* of the boss portion 54 of the retainer 50. Accordingly, in a state where the retainer 50 covers the outer surface 20*a* of the TCC 20 from the outside, the knock pin 11 on the Y1 side is fitted into the attachment hole 54*a* of the end portion 53 on the Y1 side, and the knock pin 11 on the Y2 side is fitted into the attachment hole 54*a* of the end portion 53 on the Y2 side. In this state, the bolts 90 are respectively inserted into the respective attachment holes 55*a* of the pair of boss portions 55, and the lower surfaces of the boss portions 55 are directly fixed to fixing holes 2*d* (refer to FIG. 6) of the edge portion 2*b* of the cylinder block 2, respectively. Here, the attachment hole 54*a* is a through hole, but may be a concave hole that does not penetrate an upper surface of the end portion 53 because the knock pin 11 is fitted into the attachment hole 54*a* via the lower surface of the end portion 53. The knock pin 11 is an example of a "pin member" in the embodiment disclosed here.

Accordingly, when the retainer 50 is assembled to the cylinder block 2 so as to span the TCC 20 in the Y direction, the position of the retainer 50 is determined in an attachment plane (a Y-Z plane) with respect to the cylinder block 2. The metallic retainer 50 is accurately assembled to the metallic cylinder block 2 by fitting the knock pins 11 into the respective attachment holes 54*a*, and thus a center of the through hole 52*a* is accurately aligned with respect to the shaft center of the crankshaft 40. Accordingly, the oil seal 5 is accurately press-fitted onto the crankshaft 40.

Here, in the first embodiment, as illustrated in FIGS. 5 and 6, the TCC 20 has an annular groove portion 21*b* formed around the boss portion 22 in the outer surface 20*a* that is present on the X2 side. A circular sealing member 6 of an elastic material is fitted into the groove portion 21*b*. A portion of the sealing member 6 is exposed out of the groove portion 21*b* further than the outer surface 20*a*, and is in contact with a portion of the inner surface 50*b* around the boss portion 52 of the retainer 50 facing the TCC 20. That is, the sealing member 6 is disposed between the retainer 50 (the boss portion 52) and the TCC 20 (the boss portion 22). The sealing member 6 is squeezed in the X1 direction, and thus is in close contact with a portion of the outer surface 20*a* of the TCC 20 (the boss portion 22) and the inner surface 50*b* of the retainer 50 (the boss portion 52), the portion corresponding to the vicinity of the sealing member 6. The sealing member 6 is an example of a "first sealing member" in the embodiment disclosed here.

In the first embodiment, a sealing member 7 of an elastic material is fitted into the groove portion 21*a* formed in an inner surface 20*b* of the TCC 20, the inner surface 20*b* being present on the X1 side. A portion of the sealing member 7 is exposed out of the groove portion 21*a* further than the inner surface 20*b*, and is contact with the edge portion 2*b* of the cylinder block 2 which faces the TCC 20. That is, the sealing member 7 is disposed between the cylinder block 2 (the edge portion 2*b*) and the TCC 20 (the inner surface 20*b*). The sealing member 7 is squeezed in the X1 direction, and thus is in close contact with the edge portion 2*b* of the cylinder block 2 and the inner surface 20*b* of the TCC 20. The TCC 20 is fixed to the cylinder block 2 via the sealing member 7 between the TCC 20 and the cylinder block 2, in a state where the TCC 20 is floated from the cylinder block 2 by a minimum distance of a gap L1. The sealing member 7 is an example of a "second sealing member" in the embodiment disclosed here. The gap L1 is an example of a "first gap" in the embodiment disclosed here.

Accordingly, when seen in the arrow X2 direction from the inside toward the outside of the engine main body 10, the TCC 20 is attached to the cylinder block 2 via the sealing member 7 in the edge portion 2*b* of the cylinder block 2, and the boss portion 52 of the retainer 50 is disposed on the TCC 20 so as to face the TCC 20 via the sealing member 6 around the boss portion 22 of the TCC 20, with the sealing member 6 being present opposite to the engine main body 10 (on the X2 side).

In the first embodiment, as illustrated in FIG. 4, a contact portion 56 is provided in the main body portion 51 so as to be positioned inward of the boss portions 54 and 55 of the end portion 53 of the retainer 50. The contact portion 56 protrudes in the X1 direction (a front side of the drawing sheet), and has a predetermined protrusion height. The contact portion 56 is continuously formed from an end portion on the Z1 side toward an end portion on the Z2 side of the main body portion 51. Accordingly, as illustrated in FIGS. 5 and 6, in a state where a portion of the outer surface 20*a* of the TCC 20 is disposed with a minimum distance of a gap L2 from the inner surface 50*b* of the retainer 50, the portion corresponding to the vicinity of the sealing member 6, the contact portion 56 of the retainer 50 is in contact with a portion of the outer surface 20*a*, the portion being present in the vicinity of the sealing member 7 and opposite to the mounting location of the sealing member 7. The protrusion height of the contact portion 56 is pre-adjusted so as to maintain a state in which the TCC 20 is disposed with the minimum distance of the gap L2 from a portion of the inner surface 50*b* of the retainer 50, the portion corresponding to the vicinity of the sealing member 6. The contact portion 56 is an example of a "first chain cover contact portion" in the embodiment disclosed here. The X1 direction is an example of a "first direction" in the embodiment disclosed here.

The sealing member 7 has a free state height dimension (in the X direction) greater than that of the sealing member 6. In the first embodiment, when the TCC 20 and the retainer 50 are assembled to the cylinder block 2, a reaction force F1 (a force exerted in the arrow X2 direction) of the sealing member 7 against the TCC 20 is set to be greater than a reaction force F2 (a force exerted in the arrow X1 direction) of the sealing member 6 against the TCC 20. Accordingly, the reaction force F2 does not cause the sealing member 7 to be squeezed in the X1 direction in which the gap L1 decreases, and the squeezing of the sealing member 7 is appropriately maintained.

In the first embodiment, as illustrated in FIG. 5, the boss portion 54 of the retainer 50 has an outer circumferential portion 54*b*. The outer circumferential portion 54*b* has a round side surface opposite to the contact portion 56. In contrast, the outer circumferential portion 54*b* has a side end surface 54*c* that faces the contact portion 56 and linearly extends along the Z direction in a plan view. Accordingly, when the side end surface 54*c* of the outer circumferential portion 54*b* is in contact with a side end surface 23*a* of the end portion 23 of the TCC 20 in the Y direction, the position of the TCC 20 in the Y direction (Y1 and Y2 directions) is determined with respect to the retainer 50. As illustrated in FIG. 6, the columnar outer circumferential portion 55*b* of the boss portion 55 is not in contact with the side end surface 23*a* of the TCC 20.

As illustrated in FIG. 1, in the TCC 20, a crankshaft timing gear (not illustrated) and a camshaft timing gear 31 are connected to each other via a timing chain 4. The crankshaft timing gear is attached to the crankshaft 40, and the camshaft timing gear 31 drives the camshaft (not illustrated) assembled in the cylinder head 1. A crank pulley (not illustrated) is rotatably attached to the front end portion 41 of the crankshaft 40 on the outside of the TCC 20. A belt hooked over the crank pulley drives accessories such as a water pump for the recirculation of engine coolant, and a compressor for the air conditioning of a vehicle, and both the water pump and the compressor are attached to the engine 100. A rear end portion 42 of the crankshaft 40 is connected to a power transmission unit (not illustrated) including a transmission and the like. In the first embodiment, the structures of the engine 100 and the surroundings of the TCC 20 including the retainer 50 are as described above.

In the first embodiment, it is possible to obtain the following effects.

That is, in the first embodiment, as described above, the engine 100 includes the TCC 20 attached to the engine main body 10, and the retainer 50 made of aluminum alloy that is disposed opposite to the engine main body 10 and fixes the oil seal 5, and in the structure of the TCC 20 in which the sealing member 6 is disposed between the retainer 50 and the TCC 20, and thus the TCC 20 is attached to the engine main body 10 and the retainer 50 is disposed on the outer surface 20*a* of the TCC 20, the sealing member 6 provided between the TCC 20 and the retainer 50 is squeezed in the X1 direction, and thus it is possible to bring the sealing member 6 into close contact with the outer surface 20*a* of the TCC 20 and the inner surface 50*b* of the retainer 50, with the outer surface 20*a* and the inner surface 50*b* facing each other. Accordingly, it is possible to seal the oil in the engine main body 10 (the crankcase 3) from leaking around a portion of the crankshaft 40 which is provided with the oil seal 5, and it is also possible to prevent the oil from leaking to the outside of the engine main body 10 via a gap between the TCC 20 and the retainer 50 which overlap with each other, using the sealing function of the sealing member 6. As a result, even when the oil seal 5 is mounted on the crankshaft 40 via the retainer 50 formed separately from the TCC 20, it is possible to secure sealing properties between the TCC 20 and the retainer 50.

The first embodiment further includes the sealing member 7 disposed between the TCC 20 and the engine main body 10 in addition to the sealing member 6 disposed between the retainer 50 and the TCC 20. Accordingly, it is possible to prevent oil from leaking to the outside of the engine main body 10 via a gap between the TCC 20 and the retainer 50, using the sealing function of the sealing member 6, and it is also possible to prevent oil from leaking to the outside of the engine main body 10 via a gap between the engine main body 10 and the TCC 20, using the sealing function of even the sealing member 7. As a result, it is possible to further maintain sealing properties of the engine 100.

In the first embodiment, the retainer 50 is provided with the contact portions 56 that are in contact with the TCC 20 in the vicinity of the sealing member 7. In a state where at least the gap L1 is provided between the TCC 20 and the engine main body 10, using the sealing member 7, the contact portions 56 are brought into contact with the TCC 20 from the retainer 50 toward the TCC 20 in the X1 direction. Accordingly, in a state where the contact portions 56 of the retainer 50 prevent a portion of the TCC 20 in the vicinity of the sealing member 7 from being excessively floated in the X2 direction in which the gap L1 increases, it is possible to dispose the TCC 20 in such a manner that the sealing member 7 appropriately separates the TCC 20 from the engine main body 10 by the gap L1. Accordingly, it is possible to reliably determine the position of the TCC 20 in a height direction (X1 direction) with respect to the engine main body 10 in the vicinity of the sealing member 7, and it is possible to prevent an unexpected external force or vibration of the engine main body 10 from shaking the TCC 20 that is disposed separately from the engine main body 10 by the gap L1.

In the first embodiment, when the TCC 20 and the retainer 50 are assembled to the engine main body 10, the reaction force F1 of the sealing member 7 against the TCC 20 is set to be greater than the reaction force F2 of the sealing member 6 against the TCC 20. Accordingly, it is possible to prevent the reaction force F2 of the sealing member 6 against the TCC 20 from causing the sealing member 7 to be excessively squeezed in the X1 direction in which the gap L1 decreases. That is, since the squeezing of the sealing member 7 is appropriately maintained, and thus it is possible to keep the sealing function of the sealing member 7, it is possible to reliably prevent oil from leaking to the outside via a gap between the engine main body 10 and the TCC 20, using the sealing function of the sealing member 7. Since the sealing member 7 is not excessively deformed, it is possible to prevent deterioration of the sealing member 7, and thus deterioration in the durability of the sealing member 7.

In the first embodiment, the knock pins 11 are provided in the engine main body 10 (the edge portion 2*b* of the cylinder block 2) so as to protrude in the retainer 50 (in the X2 direction). The attachment hole 54*a* is provided in the retainer 50, and is fitted into the knock pin 11, thereby determining the position of the retainer 50 with respect to the engine main body 10 (the cylinder block 2). Accordingly, the knock pin 11 of the engine main body 10 is inserted (fitted) into the attachment hole 54*a* provided in the metallic retainer 50, and thus it is possible to improve the accuracy of the fixing position of the retainer 50 with respect to the engine main body 10. As a result, it is possible to maintain a high accuracy of the mounting position of the oil seal 5 with respect to the crankshaft 40.

In the first embodiment, the boss portions 54 are provided in the retainer 50, and the side end surface 54*c* of the outer circumferential portion 54*b* is brought into contact with the side end surface 23*a* of each of the end portions 23 of the TCC 20 in the Y1 and Y2 directions which are orthogonal to the X direction in which the crankshaft 40 extends, and thus the boss portions 54 determine the position of the TCC 20 with respect to the retainer 50 in the Y direction. Accordingly, it is possible to appropriately maintain the attachment position of the TCC 20 with respect to the retainer 50 in the Y direction (a direction orthogonal to the crankshaft 40), using the boss portions 54 (the outer circumferential portions 54*b*) of the retainer 50. Accordingly, it is possible to appropriately maintain a relative positional relationship in the Y-Z plane between the retainer 50 and the TCC 20 which face each other with the sealing member 6 interposed therebetween. It is possible to prevent an unexpected external force or vibration of the engine main body 10 from causing a positional deviation of the TCC 20 in the Y direction. It is possible to easily determine the position of the TCC 20 with respect to the retainer 50 in the Y direction, using the outer circumferential portion 54*b* of the boss portion 54 provided in the retainer 50.

In the first embodiment, the TCC 20 is made of a resin material (nylon 66). Accordingly, even when the resin-made TCC 20 having a relatively large coefficient of thermal expansion and being likely to undergo a positional deviation due to thermal strain is attached to the engine main body 10, it is possible to secure the accuracy of the mounting position of the oil seal 5 with respect to the crankshaft 40, using the metallic retainer 50. Even when the TCC 20 is likely to undergo a positional deviation due to thermal strain, oil is securely sealed by the sealing member 6 interposed between the TCC 20 and the retainer 50, and thus it is possible to easily reduce the weight of the engine 100, using the resin-made TCC 20.

Modification Example of First Embodiment

Subsequently, a modification example of the first embodiment will be described with reference to FIGS. 1 and 7. In the modification example of the first embodiment, a retainer 150 is fixed to the cylinder block 2, using one additional fixing location (the boss portion 55). In the drawings, the same configuration elements as in the first embodiment are illustrated with the same reference signs assigned to the same configuration elements.

Figure 7:
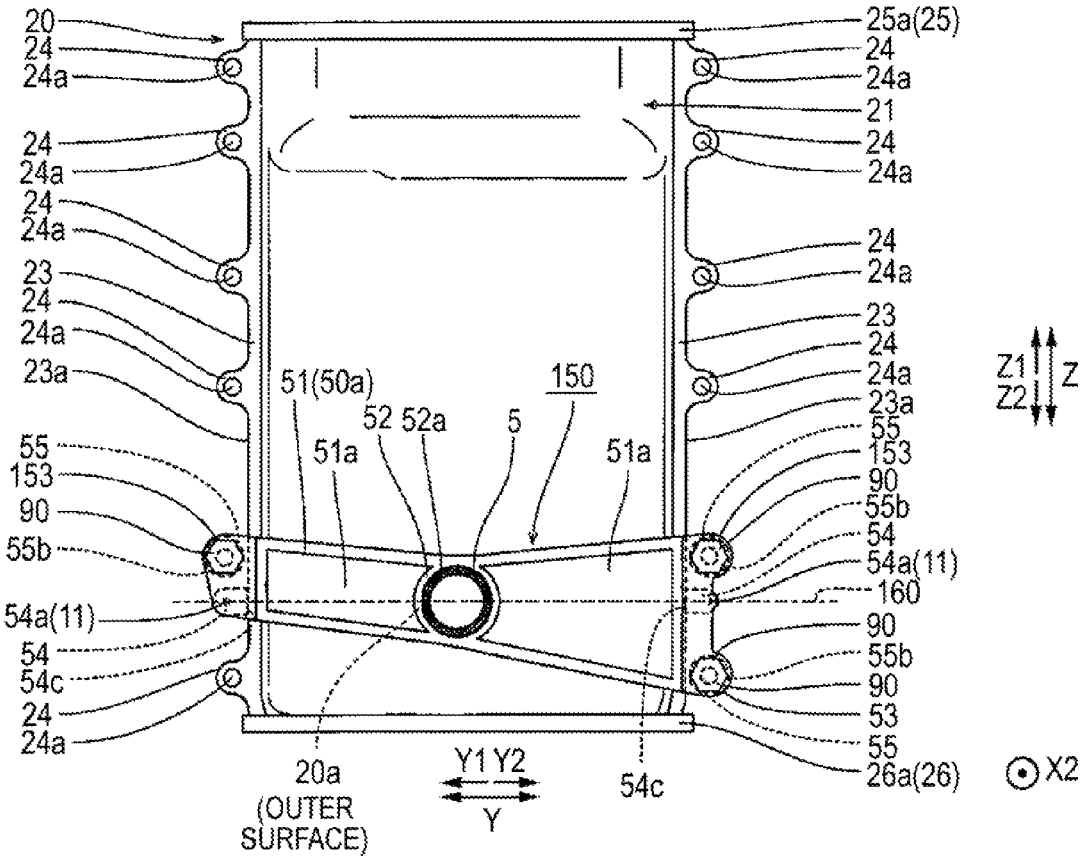
FIG. 7 is a side view illustrating a state where a retainer is assembled to the timing chain cover from the outside in the engine according to a modification example of the first embodiment disclosed here.

That is, as illustrated in FIG. 7, in the retainer 150 holding the oil seal 5, the end portion 53 on the Y1 side has one boss portion 55 and one boss portion 54, and in contrast, an end portion 153 on the Y2 side has two boss portions 55 and one boss portion 54. In the end portion 153, the boss portion 54 having the attachment hole 54*a* is disposed between the two boss portions 55 in the Z direction. A straight line 160 (an alternate long and short dash line) is disposed so as to pass through the shaft center of the crankshaft 40, and connects the boss portion 54 of the end portion 153 on the Y1 side and the boss portion 54 of the end portion 153 on the Y2 side. Accordingly, the side end surface 54*c* of the boss portion 54 on the Y1 side and the side end surface 54*c* of the boss portion 54 on the Y2 side interpose the side end surfaces 23*a* of the TCC 20 from directions opposite to each other along the straight line 160 that passes through the shaft center of the crankshaft 40. As such, the modification example of the first embodiment, the retainer 150 is attached to the cylinder block 2, using three bolts 90.

In the modification example of the first embodiment, the structure of the chain cover is the same as that of the first embodiment except that the shape of the retainer 150 is different from that of the retainer 50 (refer to FIG. 1).

In the modification example of the first embodiment, as described above, since it is possible to rigidly fix the retainer 150 to the engine main body 10 by attaching the retainer 150 to the edge portion 2*b* of the cylinder block 2, using the three bolts 90, it is possible to improve the accuracy of the mounting position of the oil seal 5 with respect to the crankshaft 40.

In the modification example of the first embodiment, the retainer 150 is formed in such a manner that the straight line 160 passes through the shaft center of the crankshaft 40, and the straight line 160 connects the boss portion 54 (the attachment hole 54*a*) of the end portion 153 on the Y1 side and the boss portion 54 (the attachment hole 54*a*) of the end portion 153 on the Y2 side. Accordingly, the action line of a force of bringing the side end surface 54*c* of the retainer 150 on the Y1 side into contact with the side end surface 23*a* of the TCC 20 in the Y direction can be aligned with the action line of a force of bringing the side end surface 54*c* of the retainer 150 on the Y2 side into contact with the side end surface 23*a* of the TCC 20 on the straight line 160, and thus it is possible to reliably interpose the TCC 20 in the Y direction using the retainer 150 without distorting the resin-made TCC 20. Other effects of the modification example of the first embodiment are the same as those of the first embodiment.

Second Embodiment

Subsequently, a second embodiment will be described with reference to FIGS. 6, 8, and 9. In the second embodiment, compared to the shape of the retainer 50 (refer to FIG. 6) in the first embodiment, a detailed shape of a retainer 250 is changed so as to improve the accuracy of the positioning of the timing chain cover (TCC) 20. In the drawings, the same configuration elements as in the first embodiment are illustrated with the same reference signs assigned to the same configuration elements.

Figure 8:
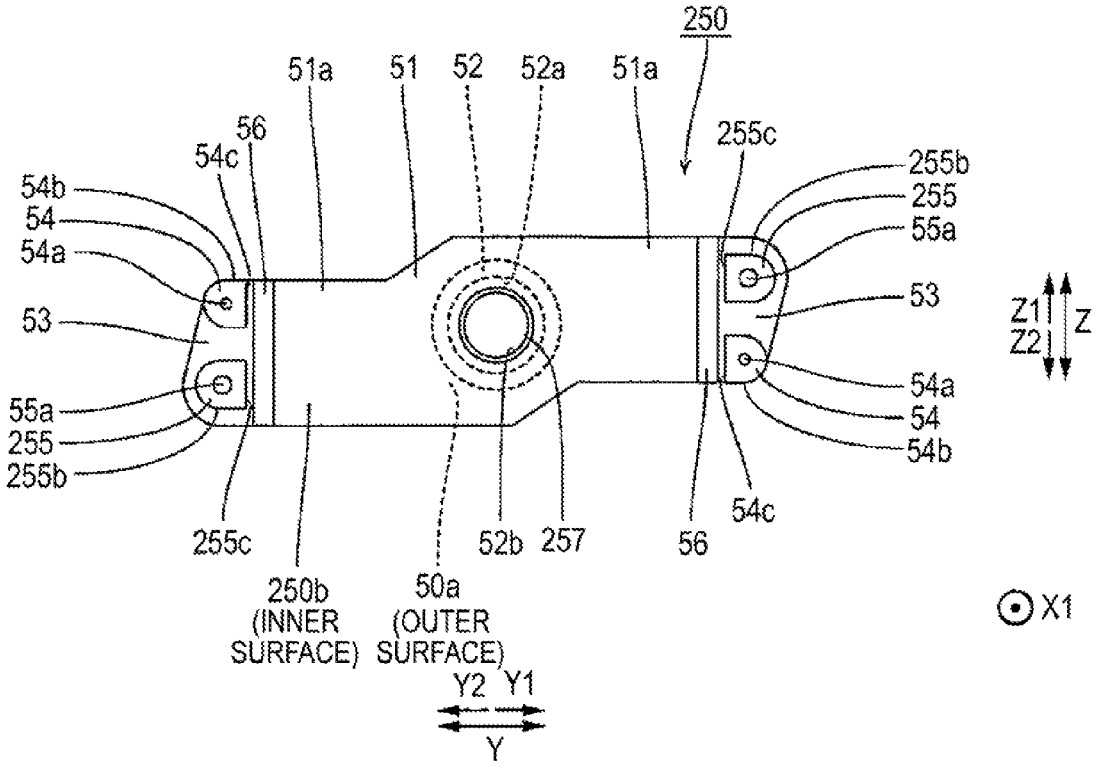
FIG. 8 is a plan view of a retainer for holding the oil seal in the engine according to a second embodiment disclosed here, when a back surface (a surface attached to an engine main body) of the retainer is seen.
Figure 9:
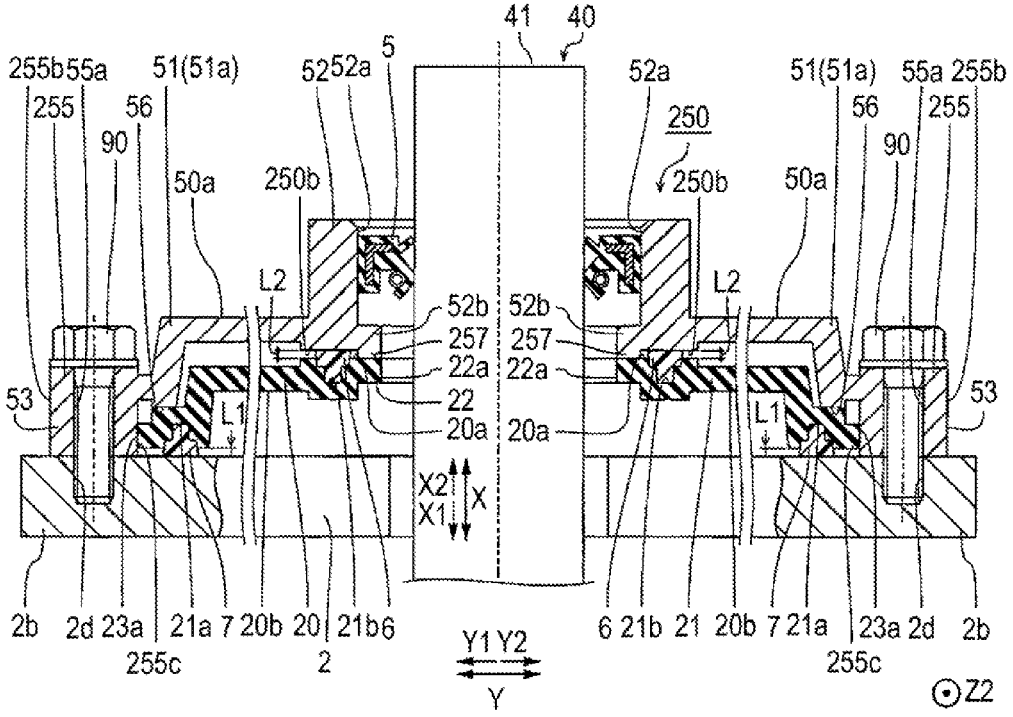
FIG. 9 is a cross-sectional view illustrating the structure of the oil seal in a state where a retainer is assembled to the timing chain cover from the outside in the engine according to the second embodiment disclosed here.

As illustrated in FIGS. 8 and 9, in the configuration of an engine according to the second embodiment disclosed here, the retainer 250 holds the oil seal 5. When a back surface of the retainer 250 is seen, as illustrated in FIG. 8, a boss portion 255 has an outer circumferential portion 255*b*. The outer circumferential portion 255*b* has a round side surface opposite to the contact portion 56. In contrast, the outer circumferential portion 255*b* has a side end surface 255*c* that faces the contact portion 56 and linearly extends along the Z direction in a plan view. Accordingly, when the side end surface 54*c* of the outer circumferential portion 54*b* is in contact with the side end surface 23*a* (refer to FIG. 9) of the end portion 23 of the TCC 20 in the Y direction, and the side end surface 255*c* of the outer circumferential portion 255*b* is concurrently in contact with the side end surface 23*a* (refer to FIG. 9) of the end portion 23 of the TCC 20 in the Y direction, the position of the TCC 20 in the Y direction (Y1 and Y2 directions) is determined with respect to the retainer 250. The boss portion 255 is an example of a "first positioning portion" and an "attachment boss" in the embodiment disclosed here.

In the second embodiment, a contact portion 257 is provided in an opening portion of the boss portion 52 of the retainer 250 on the X1 side, and has a predetermined protrusion height in the X1 direction (the front side of the drawing sheet in FIG. 8). The contact portion 257 having an annular shape is formed around the boss portion 52 of the main body portion 51. Accordingly, in a state where the TCC 20 is disposed so as to have the gap L2 with respect to an inner surface 650*b* of the retainer 250, the contact portion 257 of the retainer 250 is brought into contact with a portion of the outer surface 20*a* of the TCC 20 from the retainer 250 toward the TCC 20 in the X1 direction, the portion corresponding to the vicinity of the sealing member 6. The protrusion height of the contact portion 257 is pre-adjusted so as to maintain a state in which the TCC 20 is disposed with the gap L2 from a portion of the inner surface 650*b* of the retainer 250, the portion corresponding to the vicinity of the sealing member 6. The contact portion 257 is an example of a "second chain cover contact portion" in the embodiment disclosed here. The gap L2 is an example of a "second gap" in the embodiment disclosed here.

Accordingly, not only the contact portions 56 but also the contact portion 257 of the retainer 250 enable the TCC 20 to maintain the gap L2 (refer to FIG. 9) with respect to the retainer 250. Other configurations of the engine of the second embodiment are the same as in the first embodiment.

In the second embodiment, it is possible to obtain the following effects.

That is, in the second embodiment, the boss portions 255 are provided in the retainer 250, and the side end surface 255*c* of the outer circumferential portion 255*b* is brought into contact with the side end surface 23*a* of each of the end portions 23 of the TCC 20 in the Y1 and Y2 directions which are orthogonal to the X direction in which the crankshaft 40 extends, and thus the boss portions 255 determine the position of the TCC 20 with respect to the retainer 250 in the Y direction. Accordingly, it is possible to appropriately maintain the attachment position of the TCC 20 with respect to the retainer 250 in the Y direction, using the boss portions 255 (the outer circumferential portions 255*b*) of the retainer 250. Accordingly, it is possible to appropriately maintain a relative positional relationship in the Y-Z plane between the retainer 250 and the TCC 20 which face each other with the sealing member 6 interposed therebetween. At this time, it is possible to easily determine the position of the TCC 20 with respect to the retainer 250 in the Y direction, using not only the outer circumferential portion 54*b* (the side end surface 54*c*) of the boss portion 54 provided in the retainer 250 but also the outer circumferential portion 255*b* (the end surface 255*c*) of the boss portion 255 provided in the retainer 250. In addition, since it is possible to use the outer circumferential portion 255*b* (the side end surface 255*c*) as the "first positioning portion" that determines the position of the TCC 20 with respect to the retainer 250 in the Y direction, it is not necessary to provide a dedicated first positioning portion, and it is possible to simplify the configuration of the retainer 250 to that extent.

In the second embodiment, the contact portion 257 is provided in the retainer 250, and is in contact with the TCC 20 in the vicinity of the sealing member 6. In a state where at least the gap L2 is provided between the retainer 250 and the TCC 20, using the sealing member 6, the contact portion 257 is brought into contact with the TCC 20 from the retainer 250 toward the TCC 20 in the X1 direction. Accordingly, it is possible to maintain the gap L2 between the TCC 20 and the retainer 250 to a constant distance, using the contact portion 257 of the retainer 250, and thus it is possible to appropriately maintain the squeezing of the sealing member 6 between the TCC 20 and the retainer 250. Accordingly, it is possible to stably maintain sealing properties between the TCC 20 and the retainer 250. Other effects of the second embodiment are the same as in the first embodiment.

Third Embodiment

Subsequently, a third embodiment will be described with reference to FIGS. 2, 10, and 11. In the third embodiment, unlike the TCC 20 (refer to FIG. 2) in the first embodiment, a timing chain cover (TCC) 320 is provided with retainer boss portions 27, each of which has a fitting hole 27*a* into which the boss portion 55 of a retainer 350 is inserted and fittable. The boss portion 55 is an example of a "first positioning portion" and an "attachment boss" in the embodiment disclosed here. The retainer boss portion 27 and the fitting hole 27*a* are examples of a "second positioning portion" and an "attachment boss fitting hole", respectively in the embodiment disclosed here. In the drawings, the same configuration elements as in the first embodiment are illustrated with the same reference signs assigned to the same configuration elements.

Figure 10:
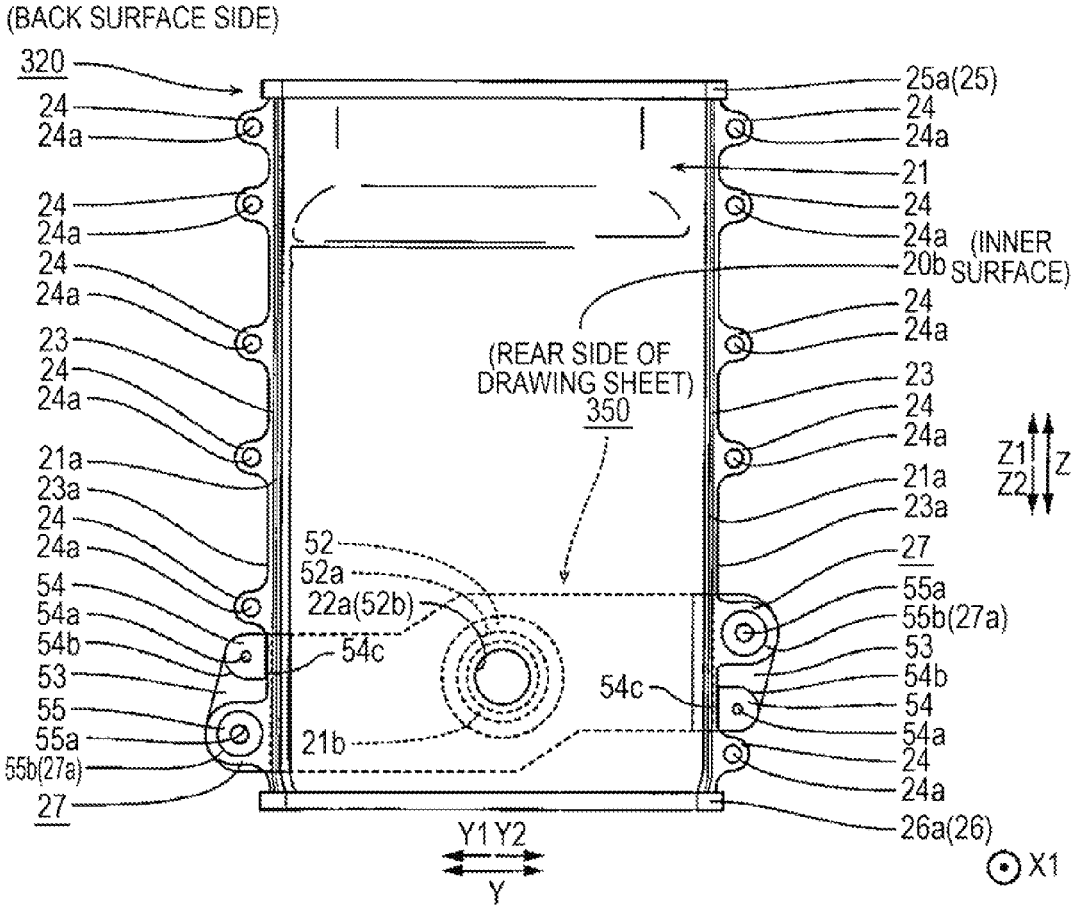
FIG. 10 is a side view of a timing chain cover to which a retainer is assembled in the engine according to a third embodiment disclosed here, when an inner surface (a surface facing a cylinder block) of the timing chain cover is seen.
Figure 11:
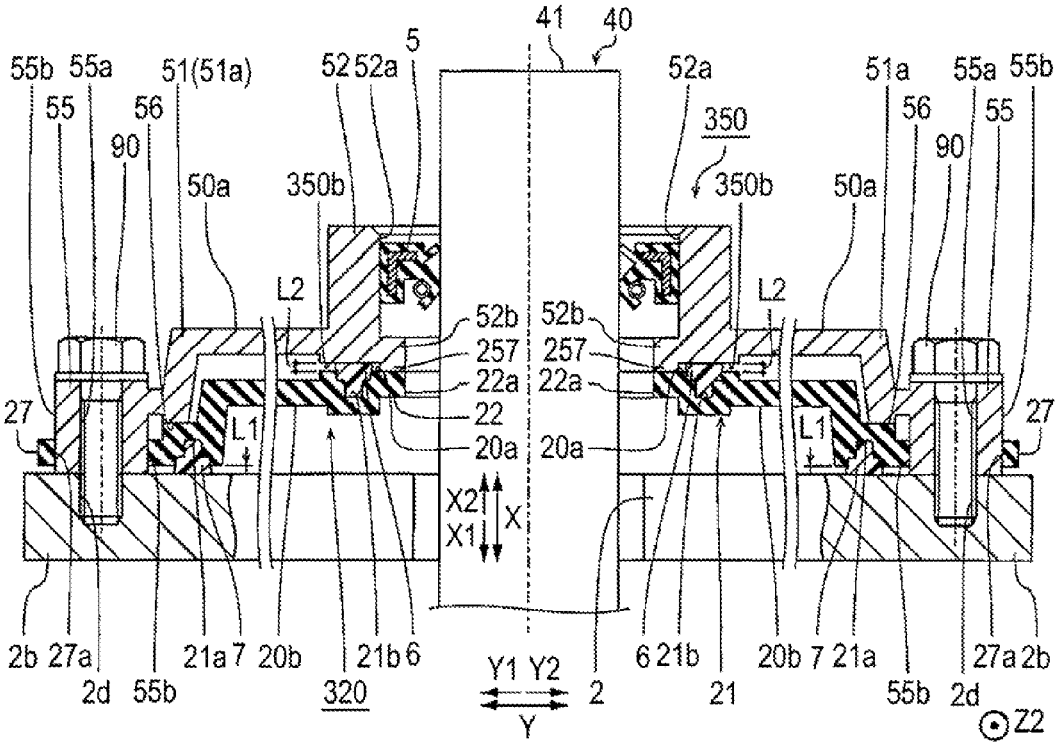
FIG. 11 is a cross-sectional view illustrating the structure of the oil seal in a state where the retainer is assembled to the timing chain cover from the outside in the engine according to the third embodiment disclosed here.

As illustrated in FIGS. 10 and 11, in the configuration of an engine according to the third embodiment disclosed here, the retainer 350 holds the oil seal 5 (refer to FIG. 11).

Here, in the third embodiment, the TCC 320 is provided with the retainer boss portions 27, each of which has the fitting hole 27*a* into which the boss portion 55 of the retainer 350 is inserted and fittable. The boss portion 55 having the attachment hole 55*a* in the retainer 350 and the retainer boss portion 27 having the fitting hole 27*a* in the TCC 320 determine the respective positions of the TCC 320 and the retainer 350 in a direction orthogonal to the X direction. That is, in a state where the retainer 350 is attached to the cylinder block 2, the fitting hole 27*a* having a circumferential inner surface in the retainer boss portion 27 of the outer TCC 320 is fitted onto an outer side of the circular outer circumferential portion 55*b* of the boss portion 55, thereby determining the respective positions of the TCC 320 and the retainer 350 in the direction orthogonal to the X direction.

As illustrated in FIG. 10, the retainer 350 also has the boss portion 54 in which the side end surface 54*c* is formed in a part of the outer circumferential portion 54*b*. Accordingly, the side end surface 23*a* is in contact with the side end surface 54*c*, and the outer circumferential portion 55*b* is fitted into the fitting hole 27*a*, thereby determining the position of the TCC 320 with respect to the retainer 350 in the direction orthogonal to the X direction.

Even in the third embodiment, as illustrated in FIG. 11, the annular contact portion 257 is provided in the opening portion of the boss portion 52 of the retainer 350 on the X1 side. Accordingly, in a state where the TCC 320 is disposed so as to have the gap L2 with respect to an inner surface 350*b* of the retainer 350, the contact portion 257 of the retainer 350 is brought into contact with a portion of the TCC 320 from the retainer 350 toward the TCC 320 in the X1 direction, the portion corresponding to the vicinity of the sealing member 6. Other configurations of the engine of the third embodiment are the same as in the second embodiment.

In the third embodiment, it is possible to obtain the following effects.

That is, in the third embodiment, as described above, the TCC 320 is provided with the retainer boss portions 27, each of which has the fitting hole 27*a* into which the boss portion 55 (the outer circumferential portion 55*b*) is inserted and fittable. The boss portion 55 having the outer circumferential portion 55*b* in the retainer 350 and the retainer boss portion 27 having the fitting hole 27*a* in the TCC 320 determine the position of the TCC 320 with respect to the retainer 350 in the direction orthogonal to the X direction. Accordingly, the outer circumferential portion 55*b* of the boss portion 55 of the retainer 350 is circumferentially fitted into the fitting hole 27*a* of the TCC 320, and thus it is possible to easily determine the position of the TCC 320 with respect to the retainer 350 in the direction orthogonal to the X direction. Since the outer circumferential portion 55*b* of the boss portion 55 is circumferentially fitted into the fitting hole 27*a* of the retainer boss portion 27, it is possible to improve the accuracy of the positioning of the TCC 320 with respect to the retainer 350 in the Y-Z plane orthogonal to the crankshaft 40. Other effects of the third embodiment are the same as in the second embodiment.

Fourth Embodiment

Subsequently, a fourth embodiment will be described with reference to FIGS. 2 and 12. In the fourth embodiment, compared to the TCC 20 (refer to FIG. 2) in the first embodiment, a timing chain cover (TCC) 420 is further provided with an engagement portion 28 that is engaged with the retainer 50. The engagement portion 28 is an example of an "oil seal fixing member engaging portion" in the embodiment disclosed here. In the drawings, the same configuration elements as in the first embodiment are illustrated with the same reference signs assigned to the same configuration elements.

Figure 12:
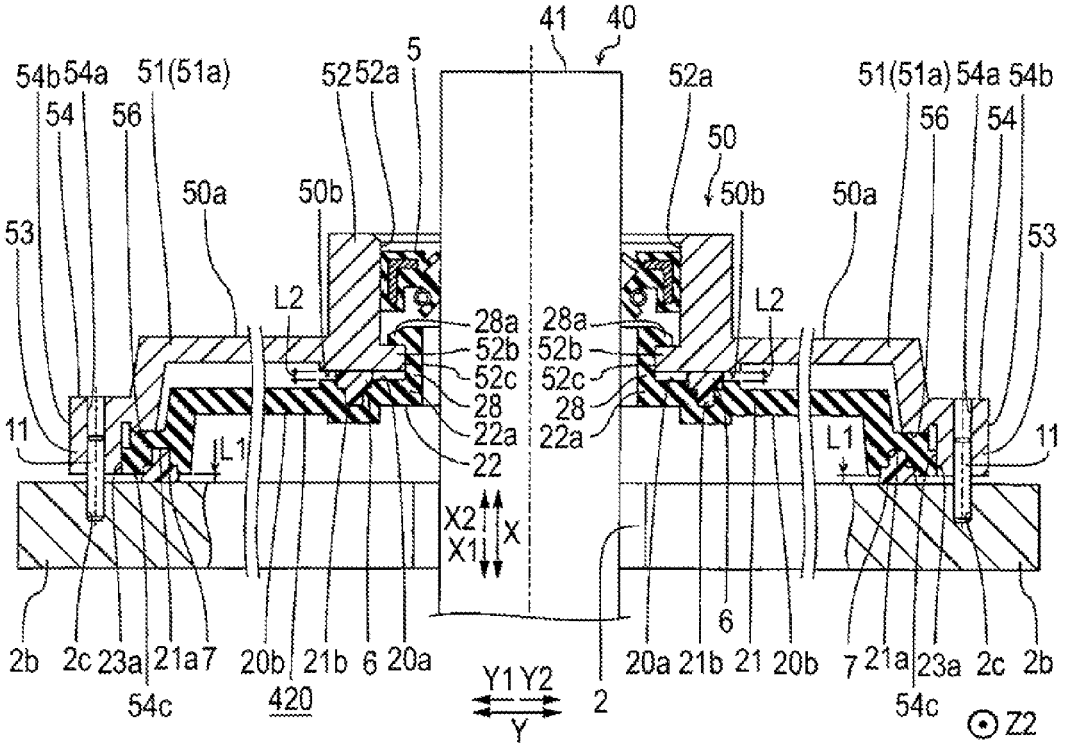
FIG. 12 is a cross-sectional view illustrating the structure of the oil seal in a state where the retainer is assembled to a timing chain cover from the outside in the engine according to a fourth embodiment disclosed here.

As illustrated in FIG. 12, in the configuration of an engine according to the fourth embodiment disclosed here, the retainer 50 holds the oil seal 5.

Here, in the fourth embodiment, the engagement portion 28 is provided in the TCC 420 in the vicinity of the sealing member 6, and is engaged with the stopping portion 52*b* of the retainer 50 via the through hole 52*a* of the retainer 50, the stopping portion 52*b* being positioned so as to face the TCC 420 (on the X2 side) and being a portion of the through hole 52*a*. That is, the engagement portion 28 has an engagement claw 28*a* that is formed by extending an inner surface of the boss portion 22 (the through hole 22*a*) of the TCC 420 in the X2 direction, and then folding the inner surface outward in a radial direction (the Y1 and Y2 sides). When a lower surface (a surface on the X1 side) of the engagement claw 28*a* is brought into contact (surface contact) with the stopping portion 52*b* from the X2 side toward the X1 side, the TCC 420 is held (fixed) by the inner surface 50*b* of the retainer 50. The engagement portion 28 and the engagement claw 28*a* having an annular shape are formed around the through hole 22*a*. The length of the engagement portion 28 in the X direction is pre-adjusted so as to maintain a state in which the TCC 420 is disposed with the gap L2 present from the inner surface 50*b* of the retainer 50. The through hole 52*a* is an example of a "crankshaft through hole" in the embodiment disclosed here.

In the fourth embodiment, since the engagement portion 28 is also in contact with an inner circumferential surface 52*c* of the through hole 52*a* (the stopping portion 52*b*) of the retainer 50, the engagement portion 28 also serves to determine the position of the TCC 420 with respect to the retainer 50 in the direction orthogonal to the X direction in which the crankshaft 40 extends. The inner circumferential surface 52*c* is an example of an "inner surface of the crankshaft through hole" in the embodiment disclosed here. Other configurations of the engine of the fourth embodiment are the same as in the first embodiment.

In the fourth embodiment, it is possible to obtain the following effects.

That is, in the fourth embodiment, as described above, the engagement portion 28 is provided in the TCC 420 in the vicinity of the sealing member 6, and is engaged with a portion of the retainer 50 via the through hole 52*a* of the retainer 50, the portion (on the X2 side) being opposite to the TCC 420. In a state where the gap L2 is provided between the retainer 50 and the TCC 420, using the sealing member 6, the engagement portion 28 is brought into contact with the retainer 50 from a side of the retainer 50 toward the retainer 50 in the X1 direction, the side being opposite to the TCC 420. Accordingly, since it is possible to maintain the gap L2 between the TCC 420 and the retainer 50 to a constant distance, in a state where the TCC 420 is disposed with respect to the retainer 50 in the X1 direction (toward the engine main body 10), using the engagement portion 28, it is possible to appropriately maintain the squeezing of the sealing member 6 between the TCC 420 and the retainer 50. Accordingly, it is possible to stably maintain sealing properties between the TCC 420 and the retainer 50. Since it is possible to easily hold the TCC 420 in the X1 direction (toward the cylinder block 2) using the engagement portion 28, it is possible to easily prevent an unexpected external force or vibration of the engine main body 10 from causing the TCC 420 to fall off from the retainer 50, the TCC 420 being disposed separately from the retainer 50 by the gap L2.

In the fourth embodiment, since the engagement portion 28 is also in contact with the inner circumferential surface 52*c* of the through hole 52*a* of the retainer 50, the engagement portion 28 also serves to determine the position of the TCC 420 with respect to the retainer 50 in the direction orthogonal to the X direction in which the crankshaft 40 extends. Accordingly, it is possible to appropriately maintain a relative positional relationship between the TCC 420 and the retainer 50 in the direction orthogonal to the crankshaft 40, using the engagement portion 28 of the TCC 420. Accordingly, it is possible to appropriately maintain the relative positional relationship between the TCC 420 and the retainer 50 which face each other with the sealing member 6 interposed therebetween. It is possible to prevent an unexpected external force or vibration of the engine main body 10 from causing a positional deviation of the TCC 420 in the Y-Z plane.

Other effects of the fourth embodiment are the same as in the first embodiment.

Fifth Embodiment

First, a fifth embodiment disclosed here will be described with reference to FIGS. 13 to 17. In the fifth embodiment, compared to the first embodiment, the respective detailed shapes of a TCC 520 and a retainer 550 are changed so as to maintain effects of reducing noise (radiated sound), which is caused by vibration of a main body of an engine 500, over a long period of time. In the drawings, the same configuration elements as in the first embodiment are illustrated with the same reference signs assigned to the same configuration elements.

Figure 13:
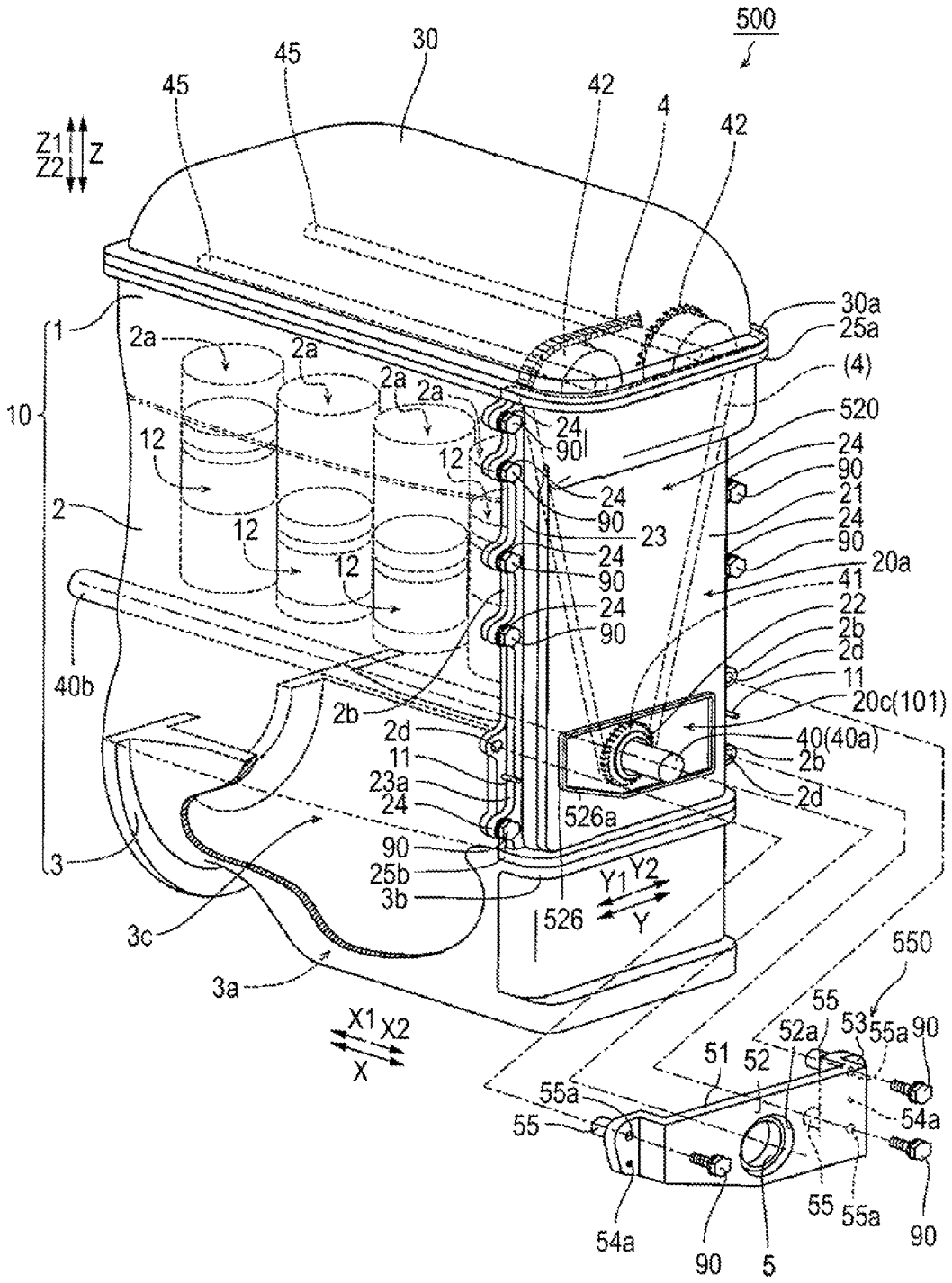
FIG. 13 is a perspective view illustrating a schematic configuration of an engine according to a fifth embodiment disclosed here.

As illustrated in FIG. 13, according to the fifth embodiment disclosed here, the engine 500 for a vehicle includes the engine main body 10 made of aluminum alloy which includes the cylinder head 1; the cylinder block 2; and the crankcase 3. The gasoline engine 500 includes the resin-made TCC 520 that is assembled to the side end portion (the edge portion 2*b*) of the engine main body 10 on the X2 side, and which covers the timing chain 4; and the head cover 30 that is assembled to the upper side (the Z1 side) of the cylinder head 1. The engine main body 10 is an example of an "internal combustion engine main body in the embodiment disclosed here. The timing chain cover (TCC) 520 is an example of a "chain cover" in the embodiments disclosed here.

Camshafts 45 (illustrated by a dotted line), a valve mechanism (not illustrated in detail), and the like are disposed in the cylinder head 1, and the camshafts 45 and the valve mechanism are moving valve system timing members. The cylinders 2*a* (illustrated by a dotted line) are formed in the cylinder block 2 connected to the lower portion (a portion on the Z2 side) of the cylinder head 1, and pistons 12 (illustrated by a dotted line) reciprocate in the cylinders 2*a* in the Z direction, respectively. An intake device (not illustrated) is connected to the cylinder head 1, and introduces intake air into the plurality of (four) cylinders 2*a* formed in the cylinder block 2.

A crank chamber 3*c* is formed in an inner bottom portion of the engine main body 10 by the cylinder block 2 and the crankcase 3 connected to the lower portion (a portion on the Z2 side) of the cylinder block 2. The crankshaft 40 is disposed in the crank chamber 3*c*, and is rotatably connected via the pistons 12 and the connecting rods (not illustrated). FIG. 13 illustrates the crankshaft 40 with a substantially bar shape, but in practice, the crankshaft 40 has a configuration in which each of crankpins and balance weights interposing the crankpin therebetween are connected to crank journals, and the crankpins with an eccentric rotary shaft are respectively disposed directly below the cylinders 2*a*.

The lower portion (a portion on the Z2 side) of the crank chamber 3*c* is provided with the oil reservoir 3*a* in which engine oil (hereinafter, simply referred to as oil) is stored. An oil pump (not illustrated) draws the oil up from the oil reservoir 3*a* to the upper portion of the engine main body 10, and supplies the oil to the moving valve system timing members including the camshafts 45 and the sliding portions such as the respective outer circumferential surfaces of the pistons 12. Thereafter, the oil falls (drips) due to its own weight and returns to the oil reservoir 3*a*.

Figure 14:
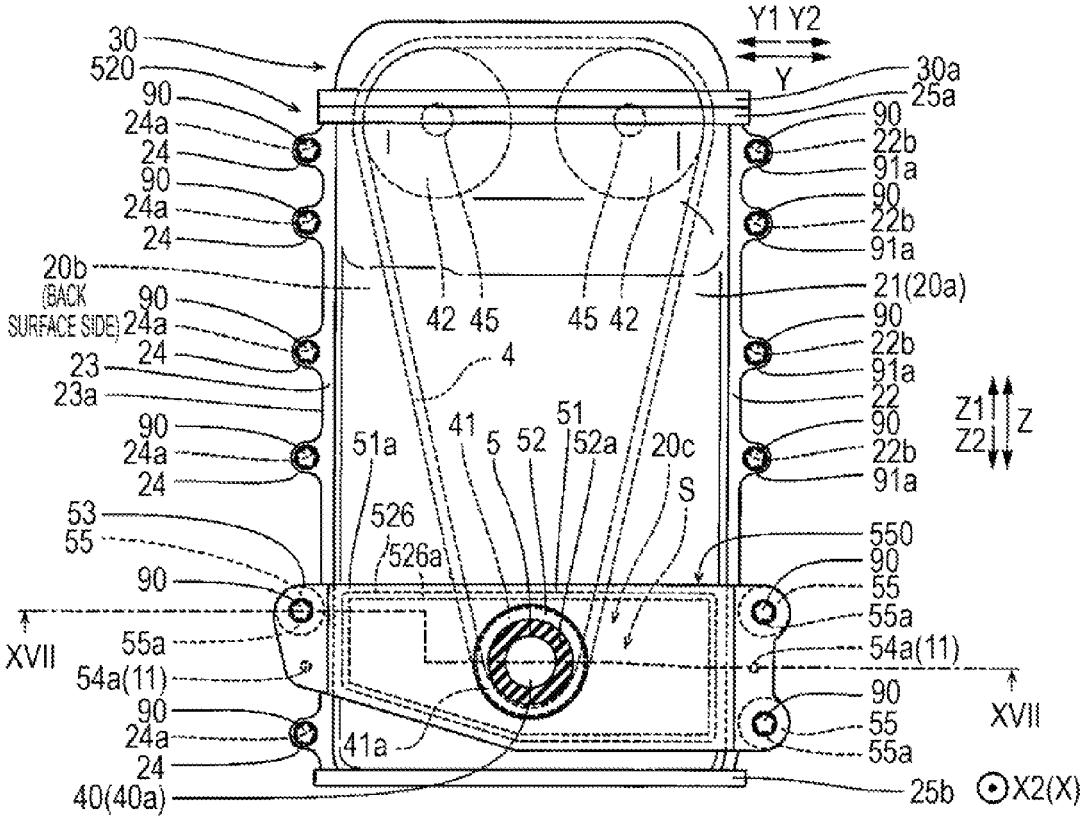
FIG. 14 is a side view in the engine according to the fifth embodiment disclosed here when a front end of a crankshaft is seen.

As illustrated in FIG. 14, the TCC 520 has a planar shape that overlaps the side cross-sectional shape of the engine main body 10 (refer to FIG. 13) on the X2 side. The TCC 520 has the main body portion 21 that swells toward the front side of the drawing sheet (in the arrow X2 direction), and the boss portion 22 (refer to FIG. 15) is formed to have the through hole 22*a* in a lower (a portion on the Z2 side) and in the vicinity of a center portion of the main body portion 21 in the Y direction. The through hole 22*a* passes through the main body portion 21 in the thickness direction of the main body portion 21, and a front end portion 40*a* (refer to FIG. 13) of the crankshaft 40 is inserted into the through hole 22*a*.

The TCC 520 has the pair of end portions 23 that are disposed in the directions (the arrow Y1 and arrow Y2 directions) opposite to each other, with the through hole 22*a* being centered between the end portions 23. Each of the flange-shaped end portions 23 is provided with the boss portions 24, each of which has the through hole 24*a* passing through in the thickness direction of the end portion 23. FIG. 14 illustrates a two-dimensional state in which the retainer 550 (to be described later) is disposed with respect to the TCC 520, and does not illustrate the cylinder block 2 that is present rearward (on the rear side of the drawing sheet) of the TCC 520.

Figure 15:
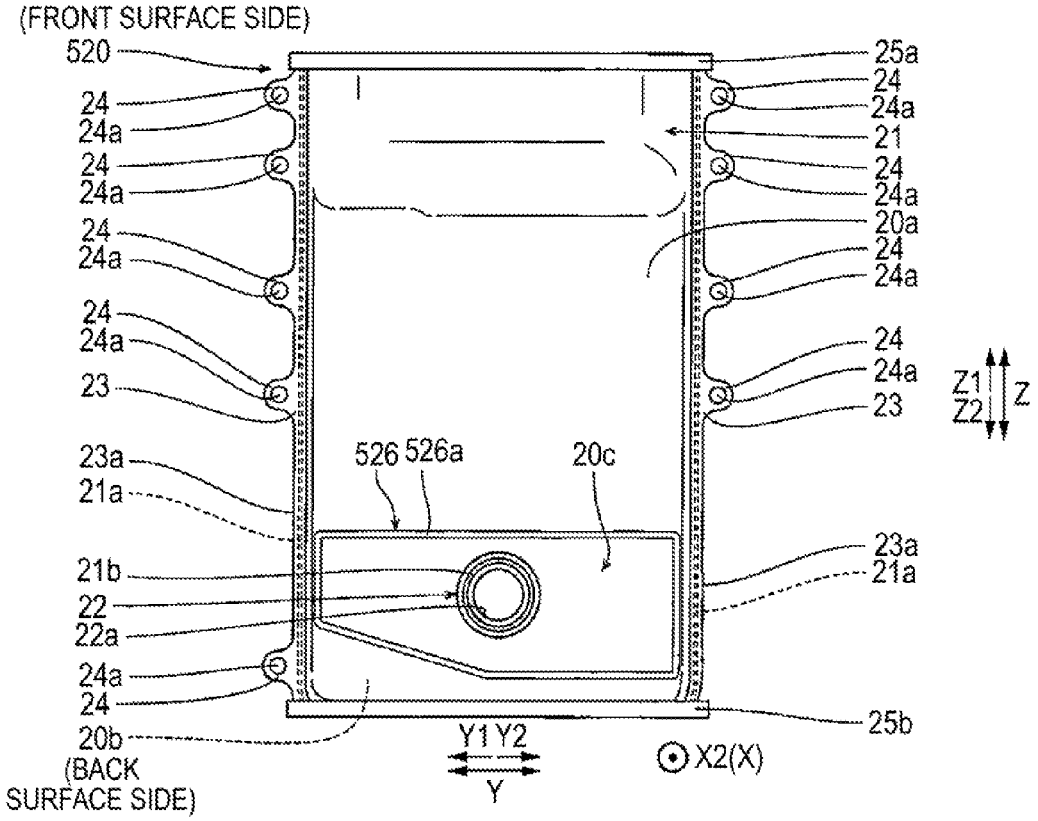
FIG. 15 is a plan view of a chain cover in the engine according to the fifth embodiment disclosed here, when seen from the outside.

As illustrated in FIG. 15, the TCC 520 has the groove portion 21*a* formed on the back surface (a sealing surface) of each of the end portions 23 that are attached to the cylinder head 1 and the cylinder block 2 (refer to FIG. 13). The groove portion 21*a* extends in the Z direction at an inner position than the through hole 22*a*, and the sealing member 7 (to be described later) (refer to FIG. 17) is fitted into the groove portion 21*a*. As illustrated in FIG. 13, in a state where the front end portion 40*a* of the crankshaft 40 on the X2 side is inserted into the through hole 22*a*, the TCC 520 is attached to the side portion (the edge portion 2*b* of the cylinder head 1 and the cylinder block 2) of the engine main body 10, using bolts 90.

Figure 17:
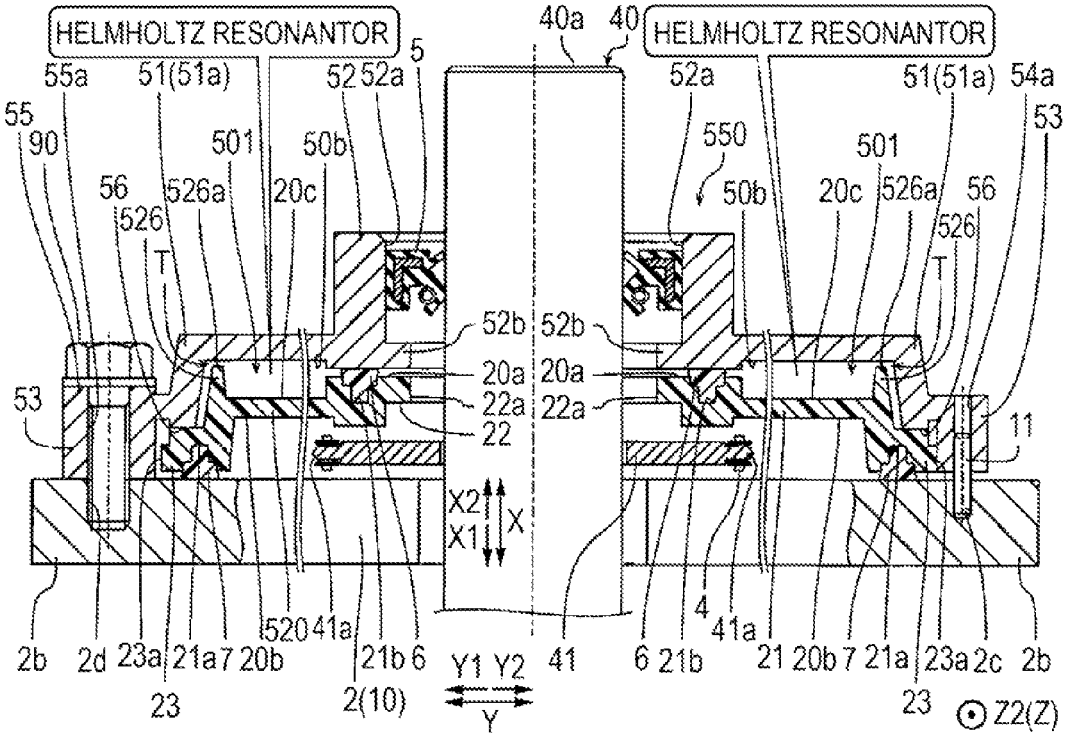
FIG. 17 is a cross-sectional view taken along line XVII-XVII in FIG. 14.

Here, as illustrated in FIG. 17, the oil seal 5 is mounted on a portion of the crankshaft 40, the portion corresponding to the through hole 22*a* of the TCC 520. The oil seal 5 is not held only by the TCC 520 in a state where the outer circumferential portion of the oil seal 5 is directly fitted to the inner circumferential surface of the through hole 22*a* of the TCC 520, but is also held by the retainer 550 made of aluminum alloy. The retainer 550 having a predetermined attachment structure is attached to the engine main body 10, and thus the oil seal 5 is mounted on the crankshaft 40 in the vicinity of the TCC 520. The oil seal 5 prevents oil in the crankcase 3 (refer to FIG. 13) from leaking to the outside of the engine main body 10 (refer to FIG. 13) via around the crankshaft 40. The retainer 550 is an example of an "oil seal fixing member" in the embodiment disclosed here.

Figure 16:
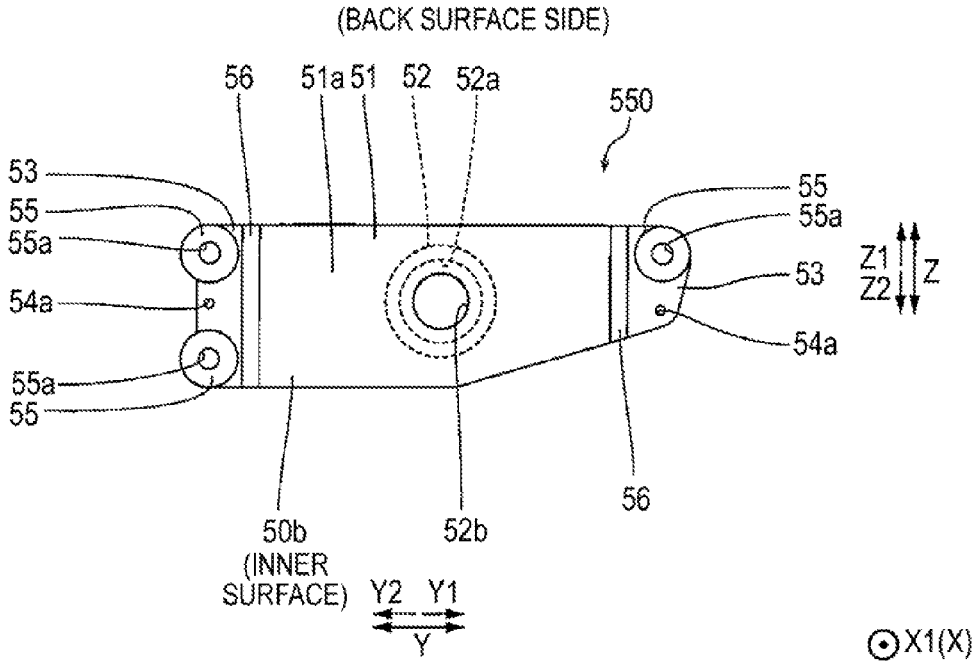
FIG. 16 is a plan view of a retainer for holding the oil seal in the engine according to the fifth embodiment disclosed here, when a back surface (a surface attached to the engine main body) of the retainer is seen.

As illustrated in FIGS. 13 and 16, the boss portion 52 is formed in the retainer 550, and has the through hole 52*a* in the center portion of the main body portion 51 along the X direction. The through hole 52*a* passes through the main body portion 51 in the thickness direction of the main body portion 51, and the front end portion 40*a* (refer to FIG. 13) of the crankshaft 40 is inserted into the through hole 52*a*. Ina cross-sectional structure of the retainer 550 illustrated in FIG. 17, the annular-shaped stopping portion 52*b* is formed on the inner circumferential surface of the through hole 52*a* of the boss portion 52, and protrudes along the Y direction so as to decrease the inner diameter of the through hole 52*a*. The oil seal 5 is fixed to the through hole 52*a* in a state where the oil seal 5 is press-fitted into the through hole 52*a* from the outside (the X2 side) toward the inside (the X1 side). The stopping portion 52*b* prevents the press-fitted oil seal 5 from excessively slipping toward the cylinder block 2 (the X1 side).

As illustrated in FIG. 16, when a back surface (the inner surface 50*b*) of the retainer 550 is seen, the retainer 550 has the pair of end portions 53. The end portions 53 are respectively formed at the respective tips of the arm portions 51*a* that extend in a longitudinal direction (Y1 and Y2 directions) with the through hole 52*a* being centered between the arm portions 51*a*. The attachment hole 54*a* and the boss portion 55 are provided in each of the end portions 53 so as to be adjacent to each other in the Z direction. The knock pin 11 (to be described later) is fitted into the attachment hole 54*a*, and the boss portion 55 has the attachment hole 55*a* into which the bolt 90 (to be described later) is inserted. At this time, the end portion 53 on the Y1 side is provided with one attachment hole 54*a* and one boss portion 55 (the attachment hole 55*a*), and the end portion 53 on the Y2 side is provided with one attachment hole 54*a* and the pair of boss portions 55 (the attachment holes 55*a*) that interpose the one attachment hole 54*a* in a vertical direction (the Z direction). The attachment holes 54*a* and 55*a* pass through the end portion 53 in the thickness direction of the end portion 53. The inner surface 50*b* is an example of a "facing surface" in the embodiment disclosed here.

As illustrated in FIG. 17, the knock pin 11 is fixed to a portion of the edge portion 2*b* of the cylinder block 2, the portion corresponding to the end portion 53 of the retainer 550, and a part of the knock pin 11 protrudes in the arrow X2 direction. The metallic knock pins 11 are respectively press-fitted into the fixing holes 2*c* by a predetermined depth, and the fixing holes 2*c* are respectively provided in the respective edge portions 2*b* of the cylinder block 2 on the Y1 and Y2 sides. The knock pin 11 has an outer diameter slightly smaller than the inner diameter of the attachment hole 54*a* of the retainer 550. Accordingly, in a state where the retainer 550 covers the outer surface 20*a* of the TCC 520 from the outside, the knock pin 11 (refer to FIG. 13) on the Y1 side is fitted into the attachment hole 54*a* of the end portion 53 on the Y1 side, and the knock pin 11 on the Y2 side is fitted into the attachment hole 54*a* of the end portion 53 on the Y2 side. In this state, the bolts 90 are respectively inserted into the respective attachment holes 55*a* of three boss portions 55, and the respective lower surfaces of the boss portions 55 are directly fixed to the fixing holes 2*d* of the edge portion 2*b* of the cylinder block 2, respectively.

Accordingly, when the retainer 550 is assembled to the cylinder block 2 so as to span the TCC 520 in the Y direction, the position of the retainer 550 is determined in the attachment plane (Y-Z plane) with respect to the cylinder block 2. The metallic retainer 550 is accurately assembled to the metallic cylinder block 2 by fitting the knock pins 11 into the respective attachment holes 54*a*, and thus the center of the through hole 52*a* is accurately aligned with respect to the shaft center of the crankshaft 40. Accordingly, the oil seal 5 is accurately press-fitted onto the crankshaft 40.

As illustrated in FIG. 15, the TCC 520 has the annular groove portion 21*b* formed around the boss portion 22 in the outer surface 20*a* that is present on the X2 side. As illustrated in FIG. 17, the annular sealing member 6 of an elastic material is fitted into the groove portion 21*b*. A portion of the sealing member 6 is exposed out of the groove portion 21*b* further than the outer surface 20*a*, and is contact with a portion of the inner surface 50*b* around the boss portion 52 of the retainer 50 facing the TCC 520. That is, the sealing member 6 is disposed between the retainer 550 (the boss portion 52) and the TCC 520 (the boss portion 22). The sealing member 6 is squeezed in the arrow X1 direction, and thus is in close contact with a portion of the outer surface 20*a* of the TCC 520 (the boss portion 22) and the inner surface 50*b* of the retainer 550 (the boss portion 52), the portion corresponding to the vicinity of the sealing member 6.

As illustrated in FIG. 17, the sealing member 7 made of an elastic material is fitted into the groove portion 21*a* formed in the back surface (in the inner surface 20*b* present on the X1 side) of the end portion 23 of the TCC 520. A portion of the sealing member 7 is exposed out of the groove portion 21*a* further than the inner surface 20*b*, and is contact with the edge portion 2*b* of the cylinder block 2, the edge portion facing the TCC 520. That is, the sealing member 7 is disposed between the cylinder block 2 (the edge portion 2*b*) and the TCC 520 (a surface of the end portion 23 on the X1 side). The sealing member 7 is squeezed in the arrow X1 direction, and thus is in close contact with the edge portion 2*b* of the cylinder block 2 and the surface of the end portion 23 on the X1 side in the TCC 520. Accordingly, the sealing member 7 is interposed between the flange-shaped end portion 23 and the edge portion 2*b*, and thus the TCC 520 is fixed to the cylinder block 2 in a state where the TCC 520 is floated from the cylinder block 2 in the arrow X2 direction by a predetermined separation distance (approximately 0.5 mm or greater and 3 mm or less).

Accordingly, as illustrated in FIG. 13, in the engine 500, the TCC 520 is attached to the engine main body 10 (the cylinder head 1 and the cylinder block 2) along the edge portion 2*b* on the side (the X2 side) of the engine main body 10 via the sealing member 7 in the arrow X1 direction, using the bolts 90. In this state, the retainer 550 is attached to the TCC 520 from the front side (the X2 side) via the sealing member 6 so as to span the outer surface 20*a* in a portion of the TCC 520 in the Y direction, the portion corresponding to the crankshaft 40 that protrudes outward from the through hole 22*a*. Accordingly, as illustrated in FIG. 14, the TCC 520 is provided with a region S in which the retainer 550 overlaps the TCC 520. The region S is an example of a "region in which the oil seal fixing member and the chain cover overlap with each other" in the embodiment disclosed here.

Here, in the fifth embodiment, as illustrated in FIG. 15, the resin-made TCC 520 is provided with a circumferential wall 526 that extends in the arrow X2 direction (a front direction of the drawing sheet) so as to keep away from the outer surface 20*a*. The circumferential wall 526 is seamlessly circumferentially formed in a predetermined region of the outer surface 20*a*, and the outer surface 20*a* is provided with a region 20*c* surrounded by the circumferential wall 526. The boss portion 22 is disposed in a center portion of the region 20*c*. As illustrated in FIG. 17, when the TCC 520 and the retainer 550 are sequentially attached to the cylinder block 2 (the engine main body 10), the circumferential wall 526 surrounds the region S (refer to FIG. 14) in which the retainer 550 and the TCC 520 overlap with each other. The arrow X2 direction is an example of a "first direction" in the embodiment disclosed here.

That is, in the engine 500, a space 501 is formed between the retainer 550 and the TCC 520, and is surrounded by the circumferential wall 526 circumferentially provided on the outer surface 20*a* of the TCC 520. In other words, the space 501 as a space structure is formed by the circumferential wall 526, the region 20*c* of the outer surface 20*a* of the TCC 520, and a portion of the flat inner surface 50*b* of the retainer 550, the portion facing the region 20*c* in the arrow X2 direction. The space 501 between the retainer 550 and the TCC 520 forms a Helmholtz resonator.

In the fifth embodiment, the circumferential wall 526 forming the space 501 (the Helmholtz resonator) in the region S (refer to FIG. 14) has a gap T between the circumferential wall 526 and a portion of the flat inner surface 50*b* of the retainer 550, the portion facing a tip 526*a* of the circumferential wall 526 in the arrow X1 direction. That is, the tip 526*a* is not in contact with the inner surface 50*b*. An inlet portion (an opening portion) of the space 501 having the gap T is circumferentially formed in a plan view. The size of the circumferentially continuous annular gap T is adjusted to a predetermined size in such a manner that the space 501 as the Helmholtz resonator has a resonance frequency to provide sound deadening effects. Accordingly, the volume of the continuous annular gap T is obtained by multiplying the width and clearance (the size of the gap) of the tip 526*a*, and the circumferential length of the tip 526*a*. The size of the gap T is set in such a manner that the shape of the space 501 cancels out a frequency which corresponds to a maximum value of noise occurring due to vibration of the engine main body 10 caused by the rotational operation of the crankshaft 40 or the like, or in particular, a maximum value of noise (operation sound resulting from a meshing operation between the timing chain 4 and a crankshaft timing sprocket 41, and the like) occurring due to vibration of moving valve system timing members which are disposed in the TCC 520 and in the vicinity of the crankshaft 40, and which corresponds to neighboring values of the maximum value. The crankshaft timing sprocket 41 is an example of a "sprocket" in the embodiment disclosed here.

Accordingly, in the engine 500, the circumferential wall 526 circumferentially provided on the outer surface 20*a* of the TCC 520 prevents noise (radiated sound) occurring in the TCC 520 from being spread to the outside of the engine main body 10, the noise occurring due to vibration of the engine main body 10 caused by the rotational operation of the crankshaft 40 or the like. That is, a ratio of the respective volumes of the gap T and the space 501 is adjusted so as to generate a Helmholtz resonance. Since the tip 526*a* of the circumferential wall 526 is not in contact with the inner surface 50*b* of the retainer 550 due to the gap T, the retainer 550 and the circumferential wall 526 (the TCC 520) do not rub against each other, the shape of the space 501 as the Helmholtz resonator is maintained, and the mechanical properties of the circumferential wall 526 are not changed (modified). Regardless of an operation period of the engine 500, the space 501 maintaining a space shape as the Helmholtz resonator cancels out a specific frequency band (a frequency at a maximum value of radiated sound and neighboring values of the maximum value) of noise (radiated sound) occurring due to vibration of the engine main body 10.

In the fifth embodiment, as illustrated in FIGS. 14 and 17, the space 501 surrounded by the circumferential wall 526 between the retainer 550 and the TCC 520 is disposed so as to overlap a meshing portion 41*a* between the timing chain 4 and the crankshaft timing sprocket 41. Accordingly, the circumferential wall 526 circumferentially provided when seen from an extending direction of the crankshaft 40 surrounds a meshing portion 41*a* in which the timing chain 4 and the crankshaft timing sprocket 41 mesh with each other, each of the timing chain 4 and the crankshaft timing sprocket 41 being one of noise sources of the engine main body 10.

As illustrated in FIG. 16, the contact portion 56 is provided in the main body portion 51 so as to be positioned inward of the boss portion 55 of the end portion 53 of the retainer 550. The contact portion 56 protrudes in the arrow X1 direction (a front side of the drawing sheet), and has a predetermined protrusion height. The contact portion 56 is continuously formed from an end portion on the Z1 side toward an end portion on the Z2 side of the main body portion 51. Accordingly, as illustrated in FIG. 17, in a state where a portion of the outer surface 20*a* of the TCC 520 is disposed with a gap from the inner surface 50*b* of the retainer 550, the portion corresponding to the vicinity of the sealing member 6, the contact portion 56 of the retainer 550 are in contact with the surface of the end portion 23 on the X2 side, the surface being present in the vicinity of the sealing member 7 and opposite to the mounting location of the sealing member 7.

The main body portion 21 of the TCC 520 has flange-shaped end portions 25*a* and 25*b*, and the respective cross sections of the end portions 25*a* and 25*b* are respectively opened to the head cover 30 (the Z1 side) and the crankcase 3 (the Z2 side). The TCC 520 and the head cover 30 are joined together using bolts (not illustrated) in a state where the end portion 25*a* faces upwards an attachment portion 30*a* of the head cover 30, and the TCC 520 and the crankcase 3 are joined together using bolts (not illustrated) in a state where the end portion 25*b* faces downwards the flange 3*b* of the crankcase 3. Sealing members (not illustrated) are respectively interposed between the end portion 25*a* and the attachment portion 30*a*, and between the end portion 25*b* and the flange 3*b*.

As illustrated in FIG. 13, in the TCC 520, the crankshaft timing sprocket 41 and a camshaft timing sprocket 42 for driving the camshaft 45 assembled in the cylinder head 1 are connected to each other via the timing chain 4. A crank pulley (not illustrated) is attached to the front end portion 40*a* of the crankshaft 40 on the outside of the TCC 520. A belt hooked over the crank pulley drives accessories such as a water pump for the recirculation of engine coolant, and a compressor for the air conditioning of a vehicle, both of the water pump and the compressor being attached to the engine 500. A rear end portion 40*b* of the crankshaft 40 is connected to a power transmission unit (not illustrated) including a transmission and the like. The engine 500 of the fifth embodiment has the above-mentioned configuration.

In the fifth embodiment, it is possible to obtain the following effects.

That is, in the fifth embodiment, as described above, the circumferential wall 526 is circumferentially provided to surround the region S in which the retainer 550 and the TCC (timing cover chain) 520 overlap with each other when seen from the extending direction (X direction) of the crankshaft 40, and the circumferential wall 526 is circumferentially provided on the outer surface 20*a* of the TCC 520 so as to protrude in the arrow X2 direction in which the retainer 550 and the TCC 520 face each other. Accordingly, it is possible to enclose noise occurring due to vibration of the engine main body 10 caused by the rotational operation of the crankshaft 40 or the like, or in particular, noise (operation sound resulting from a meshing operation between the timing chain 4 and a crankshaft timing sprocket 41, and the like) occurring due to vibration of moving valve system timing members which are disposed in the TCC 520 and in the vicinity of the crankshaft 40, inside (in the region 20*c*) the circumferential wall 526 circumferentially provided on the outer surface 20*a* of the TCC 520. That is, the circumferential wall 526 circumferentially provided can prevent noise (radiated sound) of the engine main body 10 from leaking to the outside. At this time, for example, unlike a case in which vibration energy of the TCC 520 vibrating together with the engine main body 10 is converted into frictional energy (thermal energy), thereby reducing the vibration of the TCC 520 and noise associated with the vibration, since the engine 500 adopts the configuration in which the noise of the engine main body 10 is enclosed inside (in the region 20*c*) the circumferential wall 526, using the circumferential wall 526 that does not undergo a change in mechanical properties over time, noise reduction effects do not deteriorate (decrease) over time. As a result, it is possible to maintain effects of reducing noise (radiated sound), which is caused by vibration of the engine main body 10, over a long period of time.

In the fifth embodiment, since it is possible to improve the rigidity of the resin-made TCC 520 by providing the circumferential wall 526 on the outer surface 20*a* of the TCC 520, it is possible to prevent vibration of the engine main body 10 from being considerably transmitted to the resin-made TCC 520. Accordingly, without being affected by long use of the engine 500, it is possible to reduce a level of noise (radiated sound) that is spread from the engine main body 10 to the outside due to vibration of the TCC 520 caused by vibration of the engine main body 10.

In the fifth embodiment, the Helmholtz resonator is formed by the space 501 surround by the circumferential wall 526 between the retainer 550 and the TCC 520, and has a resonance frequency at a maximum value of radiated sound and neighboring values of the maximum value, by adjusting the size of the gap T between the tip 526*a* of the circumferential wall 526 and a portion of the inner surface 50*b* of the retainer 550, the tip 526*a* of the circumferential wall 526 facing the portion. Accordingly, the space 501 is surrounded by the circumferential wall 526, and thus the space 501 as the Helmholtz resonator can be easily formed between the retainer 550 and the TCC 520. Since the size of the gap T (the size of the gap T between the tip 526*a* of the circumferential wall 526 and the inner surface 50*b* of the retainer 550) in the inlet portion (the opening portion) of the space 501 as the Helmholtz resonator is adjusted in such a manner that the Helmholtz resonator has a resonance frequency (for example, a frequency at a maximum value of radiated sound and neighboring values of the maximum value) to provide sound deadening effects, the space 501 (the Helmholtz resonator) surrounded by the circumferential wall 526 between the retainer 550 and the TCC 520 can effectively cancel out a specific frequency band of noise (radiated sound) occurring due to vibration of the engine main body 10. At this time, since the tip 526*a* of the circumferential wall 526 is not in contact with the inner surface 50*b* of the retainer 550 due to the gap T, the retainer 550 does not rub against the circumferential wall 526 (the TCC 520), and the shape of the space 501 as the Helmholtz resonator is maintained. As a result, unlike the case in which vibration energy of the engine main body 10 is converted into frictional energy, and thus noise is reduced, it is possible to continuously prevent noise from being spread, using the circumferential wall 526 that does not undergo a change in mechanical properties over time, and it is possible to effectively reduce a level of noise (radiated sound) occurring due to vibration of the engine main body 10, using the space 501 that continues to function as the Helmholtz resonator.

In the fifth embodiment, the engine main body 10 includes the timing chain 4 and the crankshaft timing sprocket 41, and when seen from the extending direction of the crankshaft 40, the space 501 surrounded by the circumferential wall 526 between the retainer 550 and the TCC 520 is disposed so as to overlap the meshing portion 41*a* between the timing chain 4 and the crankshaft timing sprocket 41. Accordingly, the circumferential wall 526 circumferentially provided when seen from the extending direction of the crankshaft 40 can easily surround the meshing portion 41*a* in which the timing chain 4 and the crankshaft timing sprocket 41 mesh with each other, each of the timing chain 4 and the crankshaft timing sprocket 41 being one of noise sources of the engine main body 10. Accordingly, noise radiated (spread) from the meshing portion 41*a* can be effectively prevented from passing through an overlapping region (the region 20*c*) of the TCC 520 and the retainer 550 in the arrow X2 direction and being spread to the outside, the overlapping region equivalent to the space 501.

In the fifth embodiment, the TCC 520 is made of resin, and the retainer 550 is made of aluminum alloy. Accordingly, even when the TCC 520 is made of resin so as to reduce the weight of the engine 500, and the retainer 550 is made of aluminum alloy so as to accurately mount the oil seal 5 on the crankshaft 40, it is possible to effectively and easily obtain noise reduction effects (continuous reduction effects of radiated sound occurring due to vibration of the engine main body 10) in the engine main body 10, using the circumferential wall 526 circumferentially provided. The TCC 520 attached to the side end portion of the engine main body 10 is made of resin, and thus it is possible to improve sound absorbing properties with respect to noise being spread from the engine main body 10, compared to when the TCC 520 is made of a metallic member.

Sixth Embodiment

Figure 18:
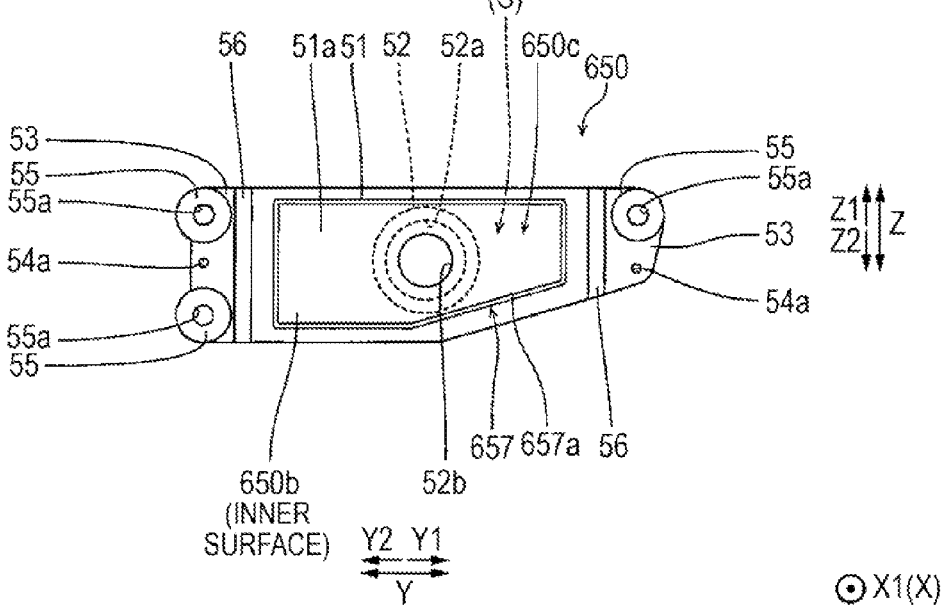
FIG. 18 is a plan view of a retainer for holding the oil seal in an engine according to a sixth embodiment disclosed here, when a back surface (a surface attached to the engine main body) of the retainer is seen.

Subsequently, a sixth embodiment will be described with reference to FIGS. 18 and 19. In the sixth embodiment, a circumferential wall 626 is formed on a TCC 620, and a circumferential wall 657 is formed on a retainer 650. The circumferential wall 657 is an example of a "first circumferential wall" in the embodiment disclosed here, and the circumferential wall 626 is an example of a "second circumferential wall" in the embodiment disclosed here. The retainer 650 is an example of an "oil seal fixing member" in the embodiment disclosed here. In the drawings, the same configuration elements as in the fifth embodiment are illustrated with the same reference signs assigned to the same configuration elements.

Figure 19:
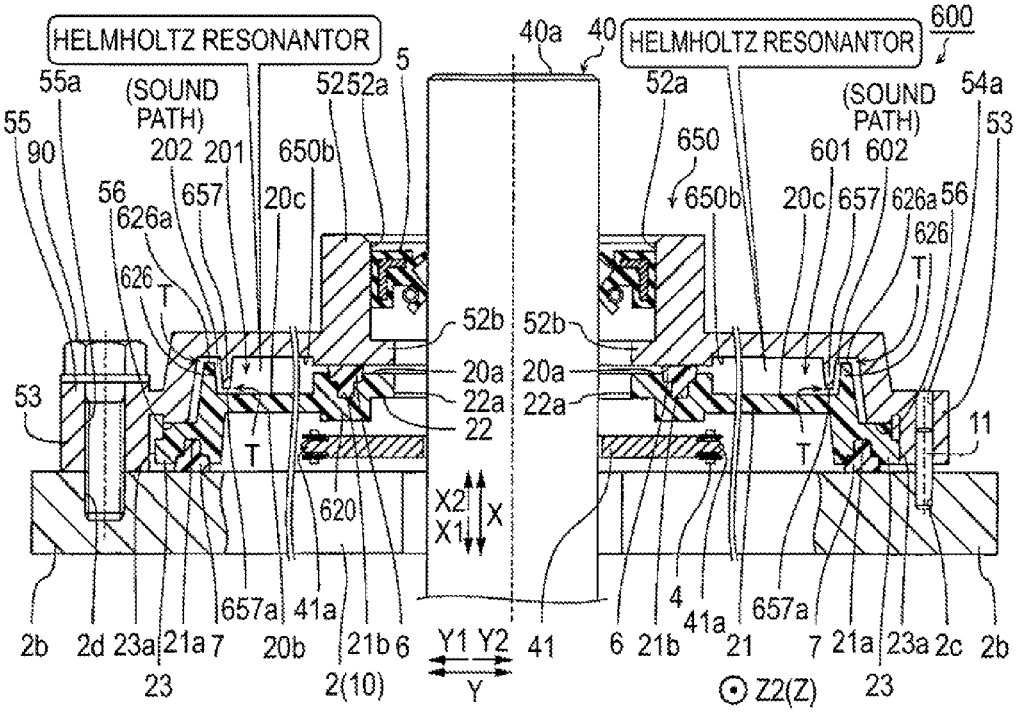
FIG. 19 is a cross-sectional view illustrating a state where a timing chain cover and the retainer are assembled to the engine main body in the engine according to the sixth embodiment disclosed here.

As illustrated in FIG. 19, in the configuration of an engine 600 according to the sixth embodiment disclosed here, the retainer 650 made of aluminum alloy holds the oil seal 5. Here, as illustrated in FIG. 18, when a back surface of the retainer 650 is seen, the retainer 650 is provided with the circumferential wall 657 that extends in the arrow X1 direction (a front direction of the drawing sheet) so as to keep away from an inner surface 650*b* of the main body portion 51. The circumferential wall 657 is seamlessly circumferentially formed in the inner surface 650*b*, and the inner surface 650*b* is provided with a region 650*c* surrounded by the circumferential wall 657. The engine 600 is an example of an "internal combustion engine" in the embodiment disclosed here. The inner surface 650*b* is an example of a "facing surface" in the embodiment disclosed here.

As illustrated in FIG. 19, when the TCC 620 and the retainer 650 are sequentially attached to the cylinder block 2 (the engine main body 10), the circumferential walls 626 and 657 surround the region S (refer to FIG. 18) in which the retainer 650 and the TCC 620 overlap with each other. At this time, a space 601 (a region 250*c*) is formed between the retainer 650 and the TCC 620, and is surrounded by the circumferential wall 657 that is circumferentially provided on the inner surface 650*b* of the inner retainer 650.

In the sixth embodiment, as illustrated in FIG. 19, the circumferential wall 657 has the gap T between the circumferential wall 657 and a portion of the outer surface 20*a* of the TCC 620, the portion facing a tip 657*a* of the circumferential wall 657 in the arrow X1 direction. That is, a tip 626*a* and the tip 657*a* are not in contact with the outer surface 20*a* of the TCC 620. The gap T is circumferentially formed in a plan view. Even in the sixth embodiment, the size of the gap T is adjusted to a predetermined size in such a manner that the space 601 as the Helmholtz resonator has a resonance frequency to provide sound deadening effects. Accordingly, in the engine 600, the Helmholtz resonator is formed by the space 601 between the retainer 650 and the TCC 620. The outer surface 20*a* is an example of a "facing surface" in the embodiment disclosed here.

Accordingly, in the engine 600, the circumferential wall 626 circumferentially provided on the outer surface 20*a* of the TCC 620, and the circumferential wall 657 circumferentially provided on the inner surface 650*b* of the retainer 650 prevent noise occurring in the TCC 620 from being spread to the outside of the engine main body 10, the noise occurring due to vibration of the engine main body 10 caused by the rotational operation of the crankshaft 40 or the like. The space 601 (the Helmholtz resonator) surrounded by the circumferential walls 626 and 657 between the retainer 650 and the TCC 620 cancels out a specific frequency band (a frequency at a maximum value of radiated sound and neighboring values of the maximum value) of noise (radiated sound) occurring due to vibration of the engine main body 10. The outer surface 20*a* is an example of the "facing surface" in the embodiment disclosed here. The arrow X1 direction is an example of a "first direction" in the embodiment disclosed here.

In the sixth embodiment, inner circumferential wall 657 and the outer circumferential wall 626 face each other with a predetermined clearance therebetween in the direction (Y and Z directions) orthogonal to the arrow X2 direction in which the crankshaft 40 extends. That is, as illustrated in FIG. 19, complicated labyrinthine sound paths 602 are formed between the circumferential walls 657 and 626, with predetermined clearances between the sound paths 602. The sound path 602 is circumferentially formed along the circumferential wall 657 (the circumferential wall 626) in a plan view.

Accordingly, in the overlapping region S (refer to FIG. 18) of the TCC 620 and the retainer 650, the region 650*c* inside the circumferential wall 657 is connected to a region (a region positioned outward of the circumferential wall 626) other than the region 650*c* in the region S via only the sound path 602 in which the TCC 620 is not in contact with (does not rub against) the retainer 650. The resonance frequency of the space 601 maintaining a space shape as the Helmholtz resonator is set to a predetermined value, using the sound path 602. At the same time, a structure having high sound shielding effects is formed in the region S by the circumferential walls (the circumferential walls 657 and 626) having the sound path 602 and a double structure. Other configurations of the engine 600 of the sixth embodiment are the same as in the fifth embodiment.

In the sixth embodiment, it is possible to obtain the following effects.

In the sixth embodiment, the TCC 620 is provided with the circumferential wall 626 that extends toward the retainer 650 in the arrow X2 direction, and the retainer 650 is provided with the circumferential wall 657 which is disposed so as to face the circumferential wall 626 with the gap T in the direction (Y and Z directions) orthogonal to the arrow X2 direction in which the crankshaft 40 extends, and which extends toward the TCC 620 in the arrow X1 direction. Accordingly, it is possible to form the circumferential walls in such a manner that the circumferential wall 626 circumferentially surrounds the circumferential wall 657 from the outside in a plan view. That is, since the circumferential wall (the circumferential walls 626 and 657) has a dual structure in which the circumferential wall 626 extends toward the retainer 650 from the TCC 620, and the circumferential wall 657 extends toward the TCC 620 from the retainer 650, it is possible to circumferentially form a labyrinthine structure (a sound shielding structure) in the vicinity of an outer edge portion of the space 601 between the retainer 650 and the TCC 620, the labyrinthine structure being formed by the sound path 602. Accordingly, noise occurring in the TCC 620 due to vibration of the engine main body 10 can be further prevented from leaking to the outside of the engine main body 10.

In the sixth embodiment, the Helmholtz resonator is formed by the space 601 surrounded by the circumferential wall 657 between the retainer 650 and the TCC 620, and the space 601 is set to have a predetermined resonance frequency by adjusting the size of the gap T between the tip 626*a* of the circumferential wall 626 and a portion of the inner surface 650*b* of the retainer 650 the portion facing tip 626*a* of the circumferential wall 626; the size of the gap T between the tip 657*a* of the circumferential wall 657 and a portion of the outer surface 20*a* of the TCC 620, the portion facing the tip 657*a* of the circumferential wall 657; and the size of the gap T between the circumferential wall 657 and the circumferential wall 626. Accordingly, the space 601 is surrounded by the circumferential wall (the circumferential walls 657 and 626) with a dual structure, and thus the space 601 as the Helmholtz resonator can be easily formed between the retainer 650 and the TCC 620. The size of the gap T (the size of the gap T between the tip 626*a* of the circumferential wall 626 and the inner surface 650*b* of the retainer 650; the size of the gap T between the tip 657*a* of the circumferential wall 657 and a portion of the outer surface 20*a* of the TCC 620, the portion facing the tip 657*a* of the circumferential wall 657; and the size of the gap T between the circumferential wall 657 and the circumferential wall 626) of the sound path 602 which is an inlet portion of the space 601 as the Helmholtz resonator is adjusted in such a manner that the Helmholtz resonator has a resonance frequency to provide sound deadening effects. Accordingly, the space 601 (the Helmholtz resonator) surrounded by the inner circumferential wall 657 can effectively cancel out a specific frequency band of noise (radiated sound) occurring due to vibration of the engine main body 10.

At this time, since the tip 626*a* of the circumferential wall 626 is not in contact with the inner surface 650*b* of the retainer 650 due to the gap T, and the tip 657*a* of the circumferential wall 657 is not in contact with the outer surface 20*a* of the TCC 620 due to the gap T, the retainer 650 (the circumferential wall 657) does not rub against the TCC 620 (the circumferential wall 626), and the shape of the space 601 as the Helmholtz resonator is maintained. As a result, it is possible to prevent noise from being continuously spread, using the circumferential wall (the circumferential walls 657 and 626) with a dual structure, and it is possible to further and continuously reduce a level of noise (radiated sound) occurring due to vibration of the engine main body 10, using the space 601 that continues to function as the Helmholtz resonator.

In the sixth embodiment, since it is possible to improve the rigidity of the TCC 620 and the retainer 650 by circumferentially providing not only the circumferential wall 626 on the resin-made TCC 620 but also the circumferential wall 657 on the metallic retainer 650, it is possible to prevent vibration of the engine main body 10 from being considerably transmitted to the TCC 620 and the retainer 650. Accordingly, without being affected by long use of the engine 600, it is possible to reduce a level of noise (radiated sound) that is spread from the engine main body 10 to the outside due to vibration of the TCC 620 and the retainer 650 caused by vibration of the engine main body 10. Other effects of the sixth embodiment are the same as in the fifth embodiment.

Seventh Embodiment

Subsequently, a seventh embodiment will be described with reference to FIGS. 17, 20, and 21. In the seventh embodiment, a sound absorbing member 701 is provided in the space 501 (refer to FIG. 17) between a retainer 750 and a TCC 720, the space 501 being formed by the circumferential wall 726 of the TCC 720. In the drawings, the same configuration elements as in the fifth embodiment are illustrated with the same reference signs assigned to the same configuration elements.

Figure 20:
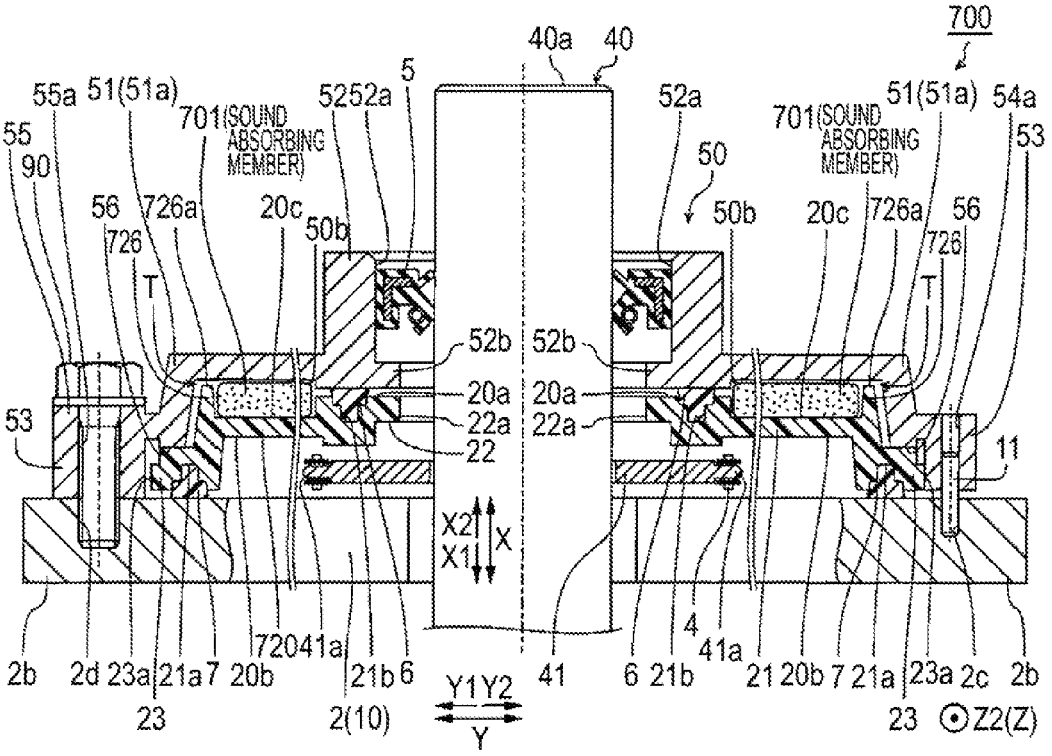
FIG. 20 is a cross-sectional view illustrating a state where a timing chain cover and a retainer are assembled to the engine main body in an engine according to a seventh embodiment disclosed here.

As illustrated in FIG. 20, in the configuration of an engine 700 according to the seventh embodiment disclosed here, the retainer 750 holds the oil seal 5 in a state where the TCC 720 is attached to the engine main body 10 (the cylinder head 1 and the cylinder block 2). In the seventh embodiment, the sound absorbing member 701 of a material having sound absorbing effects is further disposed in the space 501 (refer to FIG. 17) between the retainer 750 and the TCC 720, the space being formed by the circumferential wall 726 of the TCC 720. FIG. 20 is a cross-sectional view taken along line XX-XX (an alternate long and short dash line) in FIG. 21. The engine 700 is an example of an "internal combustion engine" in the embodiment disclosed here.

Here, the sound absorbing member 701 may be made of a foaming material (a rubber-based foaming material) such as a urethane material, or a fiber material such as glass wool. A sound absorbing member of vinyl containing bubbles or the like is applicable. That is, the sound absorbing member 701 is preferably made of a porous material containing air layers.

Figure 21:
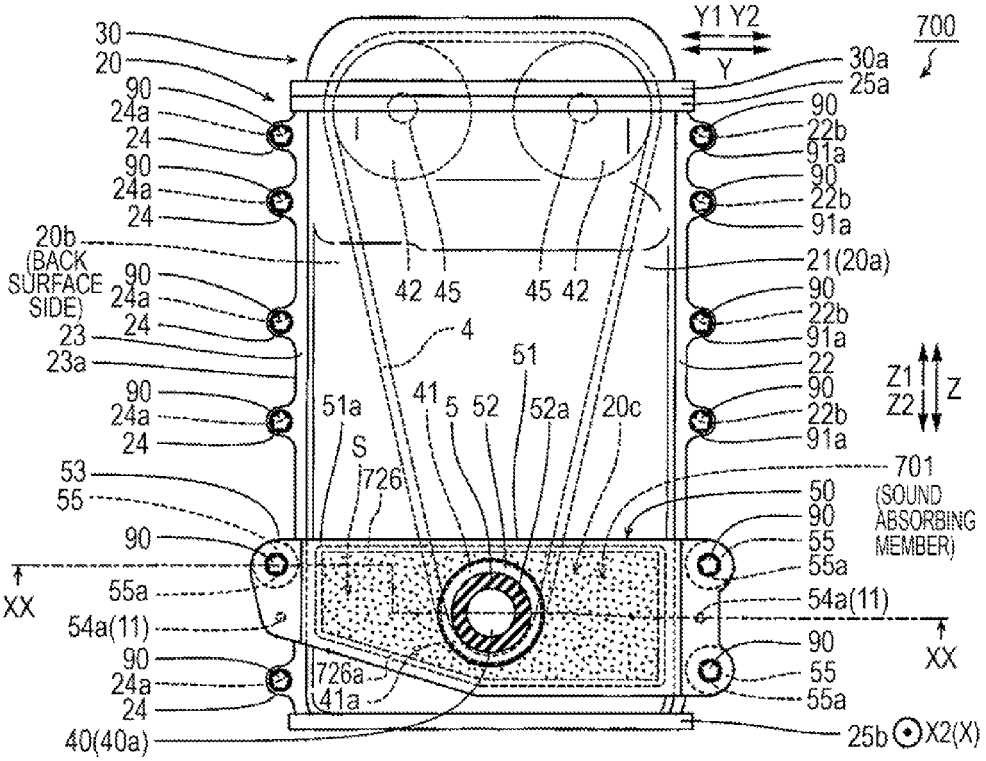
FIG. 21 is a side view illustrating a state where a sound absorbing member is disposed between the timing chain cover and the retainer in the engine according to the seventh embodiment disclosed here.

As illustrated in FIG. 21, the sound absorbing member 701 is laid in the space 501 so as to surround the crankshaft 40 and the oil seal 5 when seen from the extending direction of the crankshaft 40. Accordingly, the sound absorbing member 701 is disposed so as to overlap the meshing portion 41*a* (refer to FIG. 20) between the timing chain 4 and the crankshaft timing sprocket 41. Accordingly, in the seventh embodiment, the sound absorbing member 701 effectively prevents noise of the engine main body 10 from passing through an overlapping region (the region 20*c*) of the TCC 720 and the retainer 750 in the arrow X2 direction, and being spread to the outside, the overlapping region equivalent to the space 501 (refer to FIG. 17).

As illustrated in FIG. 20, even when the sound absorbing member 701 is laid in the space 501, some gaps remain present in the space 501 (refer to FIG. 17) in which the TCC 720 and the retainer 750 overlap with each other. For example, the gap T remains present between a tip 726*a* of a circumferential wall 726 and the inner surface 50*b* of the retainer 750. Accordingly, even when the sound absorbing member 701 is provided in the space 501, the tip 726*a* is not circumferentially in contact with the inner surface 50*b*, and the retainer 750 does not rub against the circumferential wall 726 (the TCC 720). Other configurations of the engine 700 of the seventh embodiment are the same as in the fifth embodiment.

In the seventh embodiment, it is possible to obtain the following effects.

In the seventh embodiment, as described above, the sound absorbing member 701 is provided in the space 501 surrounded by the circumferential wall 726 between the retainer 750 and the TCC 720. Accordingly, it is possible to absorb noise (radiated sound) caused by vibration of the engine main body 10, using the sound absorbing member 701 in the space 501 surrounded by the circumferential wall 726 between the retainer 750 and the TCC 720. Accordingly, in the engine 700, even at this time, unlike the case in which vibration energy of the engine main body 10 is converted into frictional energy, and thus noise is reduced, it is possible to continuously prevent noise from being spread, using the circumferential wall 726 that does not undergo a change in mechanical properties over time, and it is possible to continuously obtain noise reduction effects, using the sound absorbing member 701 for the absorption of noise. As a result, it is possible to more effectively prevent noise (radiated sound) occurring due to vibration of the engine main body 10. Other effects of the seventh embodiment are the same as in the fifth embodiment.

Eighth Embodiment

Subsequently, an eighth embodiment will be described with reference to FIGS. 17, 20, 22, and 23. In the eighth embodiment, unlike the seventh embodiment in which the sound absorbing member 701 (refer to FIG. 20) are disposed in the most part of the space 501 (refer to FIG. 17), a sound absorbing member 801 is partially provided in the space 501. In the drawings, the same configuration elements as in the seventh embodiment are illustrated with the same reference signs assigned to the same configuration elements.

Figure 23:
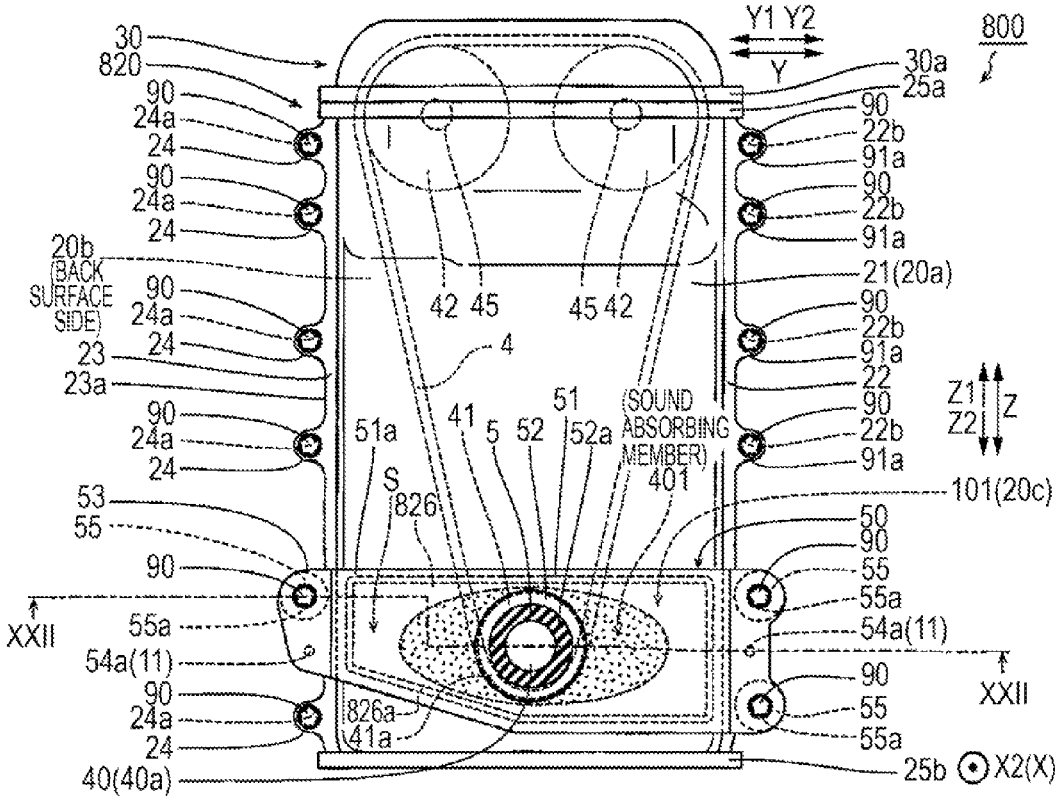
FIG. 23 is a side view illustrating a state where a sound absorbing member is disposed between the timing chain cover and the retainer in the engine according to the eighth embodiment disclosed here.

As illustrated in FIG. 23, in the configuration of an engine 800 according to the eighth embodiment disclosed here, the sound absorbing member 801 made of a material having sound absorbing effects is disposed in the space 501 between a retainer 850 and a TCC 820, the space 501 being formed by a circumferential wall 826 of the TCC 820. The engine 800 is an example of an "internal combustion engine" in the embodiment disclosed here.

Figure 22:
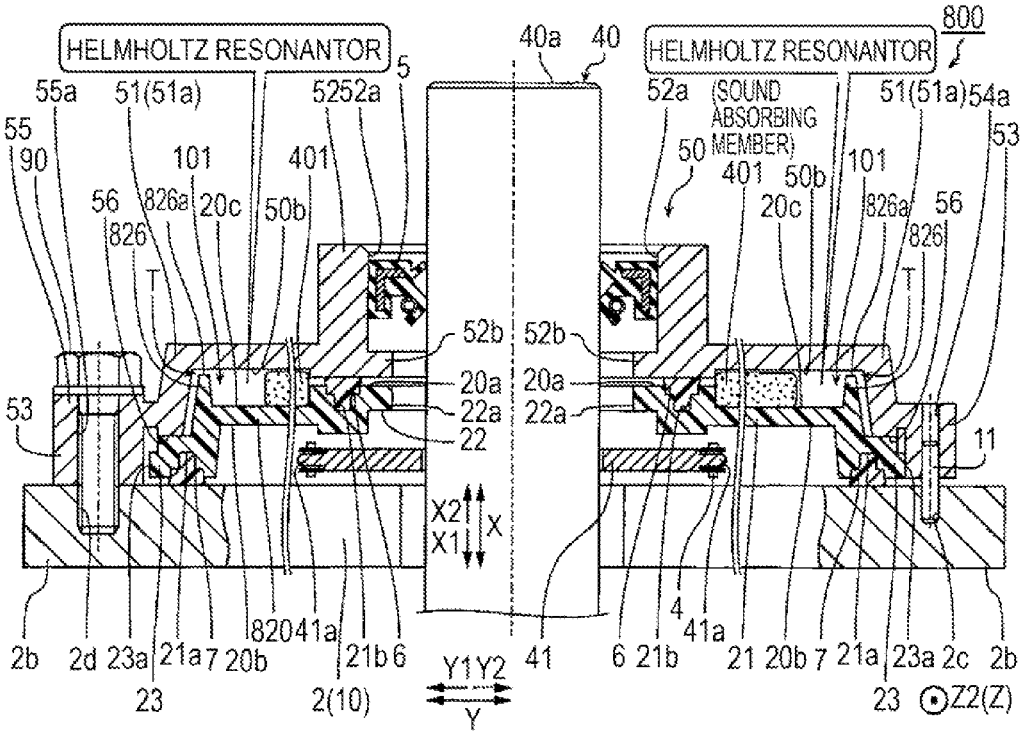
FIG. 22 is a cross-sectional view illustrating a state where a timing chain cover and a retainer are assembled to the engine main body in an engine according to an eighth embodiment disclosed here.

Here, in the eighth embodiment, as illustrated in FIGS. 22 and 23, the sound absorbing member 801 is partially filled up in the space 501. That is, the space 501 includes a region in which the sound absorbing member 801 is filled up (disposed), and a region in which the sound absorbing member 801 is not filled up (disposed) but which includes an air layer. Accordingly, in a state where the sound absorbing member 801 is partially disposed in the space 501, the size of the gap T is adjusted in such a manner that the space 501 as a space structure (a space structure that is formed by the circumferential wall 826; the region 20*c* (the outer surface 20*a*) of the TCC 820; and a portion of the inner surface 50*b* of the retainer 850, the portion facing the region 20*c*) has a resonance frequency to provide sound deadening effects. Here, the gap T is a gap between a tip 826*a* of the circumferential wall 826 and a portion of the inner surface 50*b* of the retainer 850, the portion facing the tip 826*a*. FIG. 22 is a cross-sectional view taken along line XXII-XXII (an alternate long and short dash line) in FIG. 23.

As illustrated in FIG. 23, the sound absorbing member 801 is disposed in the space 501 so as to surround the crankshaft 40 and the oil seal 5. The sound absorbing member 801 is disposed so as to overlap the meshing portion 41*a* between the timing chain 4 and the crankshaft timing sprocket 41. Other configurations of the engine 800 of the eighth embodiment are the same in the fifth embodiment.

In the eighth embodiment, it is possible to obtain the following effects.

In the eighth embodiment, as described above, since the sound absorbing member 801 is partially filled up in the space 501, the space 501 includes the region in which the sound absorbing member 801 is filled up (disposed), and the region in which the sound absorbing member 801 is not filled up (disposed) but which includes an air layer. Accordingly, even when the sound absorbing member 801 is disposed in the space 501, the space 501 as a space structure can function as the Helmholtz resonator to provide sound deadening effects in a specific frequency band. Accordingly, in the engine 800, it is possible to obtain sound absorbing effects using the sound absorbing member 801, and it is possible to continuously reduce a level of noise (radiated sound) occurring due to vibration of the engine main body 10, using the space 501 as a space structure which continuously functions as the Helmholtz resonator.

In the eighth embodiment, the sound absorbing member 801 is disposed in the space 501 so as to surround the crankshaft 40 and the oil seal 5, and overlap the meshing portion 41*a* between the timing chain 4 and the crankshaft timing sprocket 41. Accordingly, in the engine 800, even when the sound absorbing member 801 is partially disposed in the space 501, noise of the engine main body 10 including noise radiated from the meshing portion 41*a* can be effectively prevented from passing through an overlapping region (the region 20*c*) of the TCC 820 and the retainer 850 in the arrow X2 direction and being spread to the outside, the overlapping region equivalent to the space 501. Other effects of the eighth embodiment are the same as in the seventh embodiment.

It can be considered that the embodiments disclosed here are exemplified in all respects, and this disclosure is not limited to the embodiments. The scope of this disclosure is not given by the descriptions of the embodiments but by the appended claims, and includes all of modifications insofar as the modifications do not depart from meaning and a scope equal to the appended claims.

For example, in the first to eighth embodiments and the modification example of the first embodiment, a portion of the outer circumferential portion 54*b* of the boss portion 54 in the retainer 50 (150, 250, 350, 550, 750, 850) is formed by the side end surface 54*c* extending linearly along the Z direction, the portion being in contact with the side end surface 23*a* of the end portion 23 of the TCC 20 (320, 420, 520, 620, 720, 820). However, this disclosure is not limited to the embodiments disclosed here. That is, the outer circumferential portion 54*b* of the boss portion 54 may have a circular shape. Even when the outer circumferential portion 54*b* having a circular shape is in line contact with the side end surface 23*a* of the TCC 20, it is possible to determine the position of the TCC 20 with respect to the retainer 50 in the Y direction (Y1 and Y2 directions).

In the second embodiment, a portion of the outer circumferential portion 255*b* of the boss portion 255 in the retainer 250 is formed by the side end surface 255*c* extending linearly along the Z direction, the portion being in contact with the side end surface 23*a* of the end portion 23 of the TCC 20. However, this disclosure is not limited to the embodiment disclosed here. That is, the outer circumferential portion 255*b* of the boss portion 255 may have a circular shape. Even when the outer circumferential portion 255*b* having a circular shape is in line contact with the side end surface 23*a* of the TCC 20, it is possible to determine the position of the TCC 20 with respect to the retainer 250 in the Y direction (Y1 and Y2 directions).

In the second embodiment, the annular contact portion 257 of the retainer 250 is formed around the boss portion 52 of the main body portion 51. However, this disclosure is not limited to the embodiment disclosed here. That is, when the retainer 250 is provided with the "second chain cover contact portion" that is brought into contact with a portion of the outer surface 20*a* of the TCC 20 in the X1 direction, the portion corresponding to the vicinity of the sealing member 6, for example, the contact portion may have a partial arc shape other than an annular shape.

In the first to eighth embodiments and the modification example of the first embodiment, the contact portion 56 of the retainer 50 (150, 250, 350, 550, 650, 750, 850) is continuously formed from the end portion on the Z1 side toward the end portion on the Z2 side of the main body portion 51. However, this disclosure is not limited to the embodiments disclosed here. When the retainer 250 is provided with the "first chain cover contact portion" that is brought into contact with a portion of the outer surface 20*a* of the TCC 20 in the X1 direction, the portion corresponding to the vicinity of the sealing member 7, the contact portion may not continuously form from the end portion on the Z1 side toward the end portion on the Z2 side.

In the fourth embodiment, the annular engagement portion 28 of the TCC 420 is formed around the through hole 22*a*. However, this disclosure is not limited to the embodiment disclosed here. When the TCC 420 is provided with the "oil seal fixing member engaging portion" in such a manner that the lower surface of the engagement claw 28*a* is brought into contact with the stopping portion 52*b* from the X2 side toward the X1 side, and thus the TCC 420 is held (fixed) by the inner surface 50*b* of the retainer 50, for example, the engagement portion may have a partial arc shape other than an annular shape.

In the third embodiment, the side end surface 23*a* is in contact with the side end surface 54*c*, and the outer circumferential portion 55*b* is fitted into the fitting hole 27*a*, thereby determining the position of the TCC 320 with respect to the retainer 350 in the direction orthogonal to the X direction. However, this disclosure is not limited to the embodiment disclosed here. That is, the position of the TCC 320 may be determined with respect to the retainer 350 in the direction orthogonal to the X direction, only by fitting the outer circumferential portion 55*b* into the fitting hole 27*a*.

In the third embodiment, the position of the TCC 320 may be determined with respect to the retainer 350 in the direction orthogonal to the X direction, only by fitting the columnar outer circumferential portion 55*b* into the columnar fitting hole 27*a*. However, this disclosure is not limited to the embodiment disclosed here. That is, insofar as the fitting hole 27*a* and the outer circumferential portion 55*b* can be fitted into each other, for example, an inner circumferential surface of the fitting hole 27*a* and an outer circumferential surface of the outer circumferential portion 55*b* may have a polygonal shape other than a circular shape.

In the first to eighth embodiments and the modification example of the first embodiment, the sealing member 7 is set to have a height dimension greater than that of the sealing member 6, and thus the reaction force F1 of the sealing member 7 against the TCC 20 is set to be greater than the reaction force F2 of the sealing member 6 against the TCC 20. However, this disclosure is not limited to the embodiment disclosed here. For example, the reaction force F1 of the sealing member 7 against the TCC 20 may be set to be greater than the reaction force F2 of the sealing member 6 against the TCC 20 by setting the shape (the height in a natural state) of the sealing member 7 to be the same as that of the sealing member 6, and in contrast, the material hardness of the sealing member 7 to be different from that of the sealing member 6.

In the first to eighth embodiments and the modification example of the first embodiment, the main body portion 51 of the retainer 50 (150, 250, 350, 550, 650, 750, 850) is provided with the contact portion 56 that protrudes in the X direction, and is in contact with a portion of the outer surface 20*a* of the TCC 20 (320, 420, 520, 620, 720, 820), the portion corresponding to the vicinity of the sealing member 7. However, this disclosure is not limited to the embodiments disclosed here. For example, the retainer 50 may be provided with the "first chain cover contact portion" that does not protrude in the X1 direction. At this time, in the vicinity of the sealing member 7, a flat back surface (the inner surface 50*b*) of the retainer 50 may be in contact with the flat outer surface 20*a* of the TCC 20. The outer surface 20*a* may be provided with a convex portion that protrudes in the X2 direction (toward the retainer 50), and the flat back surface (the inner surface 50*b*) of the retainer 50 may be in contact with the convex portion. It is preferably possible to determine the position of the TCC 20 relative to the retainer 50 in the height direction (the X direction), using the "first chain cover contact portion" in the embodiments disclosed here.

In the second and third embodiments, the main body portion 51 of the retainer 250 (350) is provided with the contact portion 257 that protrudes in the X direction, and is in contact with a portion of the outer surface 20*a* of the TCC 20 (320), the portion corresponding to the vicinity of the sealing member 6. However, this disclosure is not limited to the embodiments disclosed here. For example, the retainer 250 may be provided with the "second chain cover contact portion" that does not protrude in the X1 direction. At this time, in the vicinity of the sealing member 6, a flat back surface (the inner surface 650*b*) of the retainer 250 may be in contact with the flat outer surface 20*a* of the TCC 20. The outer surface 20*a* may be provided with a convex portion that protrudes in the X2 direction (toward the retainer 250), and the flat back surface (the inner surface 650*b*) of the retainer 250 may be in contact with the convex portion. It is preferably possible to determine the position of the TCC 20 relative to the retainer 250 in the height direction (the X direction), using the "second chain cover contact portion" in the embodiments disclosed here.

In the fifth embodiment, the space 501 is configured when the circumferential wall 526 is formed on the outer surface 20*a* of the TCC 520 so as to extend toward the inner surface 50*b* of the retainer 550. However, this disclosure is not limited to the embodiment disclosed here. That is, as illustrated in the sixth embodiment, the "space" in embodiments disclosed here may be configured when the circumferential wall 526 is not formed, but only the circumferential wall 657 is formed on the inner surface 650*b* of the retainer 650 so as to extend toward the outer surface 20*a* of the TCC 520.

In the fifth embodiment, the space 501 is configured when the circumferential wall 526 is formed on the outer surface 20*a* of the TCC 520 so as to extend toward the flat inner surface 50*b* of the retainer 550. However, this disclosure is not limited to the embodiment disclosed here. That is, the "space" in embodiment disclosed here may be configured when the circumferential walls protrude from the outer surface 20*a* of the TCC 520 and the inner surface 50*b* of the retainer 550, respectively, in such a manner that the respective tips of the circumferential walls face each other with a predetermined gap present therebetween in the X direction (the first direction). Even in the configuration of the modification example, the "space" in the embodiment disclosed here can be provided between the TCC 520 and the retainer 550, and the space can function as the Helmholtz resonator.

In the sixth embodiment, the dual structure of the "circumferential wall" in the embodiment disclosed here is configured when the circumferential walls 626 and 657 are respectively formed in the TCC 620 and the retainer 650. However, this disclosure is not limited to the embodiment disclosed here. For example, a single or a dual "circumferential wall" in the embodiment disclosed here may be further formed inside the circumferential wall 657. As such, when the multiple "circumferential walls" in the embodiment disclosed here are formed in the region S in which the TCC 620 and the retainer 650 overlap with each other, it is possible to further improve continuous effects of shielding noise of the engine main body 10.

In the fifth to eighth embodiments, the "circumferential wall" in the embodiments disclosed here is circumferentially formed along the exterior shape of the main body portion 51 of the retainer 550 (650, 750, 850). However, this disclosure is not limited to the embodiments disclosed here. The "circumferential wall" in the embodiments disclosed here may have a two-dimensional shape other than the above-mentioned shape. For example, the "circumferential wall" in the embodiments disclosed here may have a circular shape or an elliptical shape (elongated hole shape) so as to surround the crankshaft 40 and the oil seal 5. The space formed by the circumferential wall between the retainer 550 (650, 750, 850) and the TCC 520 (620, 720, 820) is preferably positioned so as to overlap the meshing portion 41*a* between the timing chain 4 and the crankshaft timing sprocket 41, or to be positioned outward of the meshing portion 41*a*.

In the fifth to eighth embodiments, the circumferential wall 526 (626, 726, 826) is seamlessly circumferentially formed, but this disclosure is not limited to the embodiments disclosed here. That is, insofar as the circumferential wall is circumferentially provided so as to surround the region S in which the retainer 550 (650, 750, 850) and the TCC 520 (620, 720, 820) overlap each other, a part of the circumferential wall may be cut away. At this time, end portions of cut-away parts of the circumferential wall and the vicinity thereof may face each other (overlap with each other) with a predetermined gap present therebetween in the second direction (Y direction or Z direction).

In the seventh embodiment, the sound absorbing member 701 is laid unlike the seventh embodiment in which the sound absorbing member 701 are disposed to be laid in the most part of the space 501, but this disclosure is not limited to the embodiment disclosed here. For example, a plurality of the divided "sound absorbing members" may be disposed so as to form an island shape in the space 501.

In the sixth embodiment, the dual structure of the "circumferential wall" in the embodiment disclosed here is configured when the circumferential walls 626 and 657 are respectively formed in the TCC 620 and the retainer 650, but this disclosure is not limited to the embodiment disclosed here. That is, the sound absorbing member 701 illustrated in the seventh embodiment may be laid in the space 601 inside the circumferential wall having a dual structure, and the sound absorbing member 801 illustrated in the eighth embodiment may be disposed in the space 601 inside the circumferential wall having a dual structure in a state where a part of the space 601 remains empty (the space 601 is present).

In the first to eighth embodiments and the modification example of the first embodiment, the retainer 50 (150, 250, 350, 550, 650, 750, 850) is made of aluminum alloy, but this disclosure is not limited to the embodiments disclosed here. That is, the "oil seal fixing member" in the embodiments disclosed here may be made of a metallic material other than aluminum alloy.

In the first to eighth embodiments and the modification example of the first embodiment, the TCC 20 (320, 420, 520, 620, 720, 820) is made of a resin material such as nylon 66, but this disclosure is not limited to the embodiments disclosed here. That is, the "chain cover" in the embodiments disclosed here may be made of a resin material other than nylon 66, and the "chain cover" in the embodiments disclosed here may be made of a material other than a resin material.

In the first to eighth embodiments and the modification example of the first embodiment, this disclosure is applied to the gasoline engine 100 for a vehicle, but this disclosure is not limited to the embodiments disclosed here. That is, insofar as internal combustion engines have a crankshaft, this disclosure may be applied to the structure of a chain cover of gas engines (internal combustion engines such as a diesel engine and a gas engine) other than a gasoline engine. For example, this disclosure may be applied to the structure of a chain cover of an internal combustion engine that is mounted as a drive source (power source) of equipment other than a vehicle.

An internal combustion engine according to an aspect of this disclosure includes a chain cover that is attached to an internal combustion engine main body having a crankshaft; an oil seal that is mounted on the crankshaft in the vicinity of the chain cover; a metallic oil seal fixing member that is disposed on a surface of the chain cover, the surface being present opposite to the internal combustion engine main body, and fixes the oil seal; and a first sealing member that is disposed between the oil sealing fixing member and the chain cover.

According to the aspect of this disclosure, as described above, since the internal combustion engine includes the chain cover that is attached to the internal combustion engine main body; and the metallic oil seal fixing member that is disposed on the surface of the chain cover and fixes the oil seal, the surface being present opposite to the internal combustion engine main body, and the first sealing member is provided between the oil seal fixing member and the chain cover, in the structure of the chain cover in which the chain cover is attached to the internal combustion engine main body, and the oil seal fixing member is disposed on an outer surface of the chain cover, the first sealing member provided between the chain cover and the oil seal fixing member is squeezed, and thus it is possible to bring the first sealing member into close contact with the respective facing surfaces of the chain cover and the oil seal fixing member. Accordingly, oil in the internal combustion engine main body can be sealed around a portion of the crankshaft, the portion being provided with the oil seal, and it is possible to prevent the oil in the internal combustion engine main body from leaking to the outside via a gap in which the chain cover and the oil seal fixing member overlap with each other, using the sealing function of the first sealing member. As a result, even when the oil seal is mounted on the crankshaft via the oil seal fixing member formed separately from the chain cover, it is possible to secure sealing properties between the chain cover and the oil seal fixing member.

In the internal combustion engine according to the aspect, it is preferable that the internal combustion engine further includes a second sealing member that is disposed between the chain cover and the internal combustion engine main body. In this configuration, it is possible to prevent oil from leaking to the outside via a gap between the chain cover and the oil seal fixing member, using the sealing function of the first sealing member, and it is possible to prevent oil from leaking to the outside of the internal combustion engine main body via a gap between the internal combustion engine main body and the chain cover, using the sealing function of the second sealing member. As a result, it is possible to further maintain sealing properties of the internal combustion engine.

In the configuration in which the internal combustion engine further includes the second sealing member, it is preferable that the oil seal fixing member includes a first chain cover contact portion that is in contact with the chain cover in the vicinity of the second sealing member, and in a state where a first gap is provided between the chain cover and the internal combustion engine main body by the second sealing member, the first chain cover contact portion is brought into contact with the chain cover from the oil seal fixing member toward the chain cover in a first direction. In this configuration, in a state where the first chain cover contact portion of the oil seal fixing member prevents a portion of the chain cover in the vicinity of the second sealing member from being excessively floated in a direction in which the first gap increases, it is possible to dispose the chain cover in such a manner that the second sealing member appropriately separates the chain cover from the internal combustion engine main body by the first gap. Accordingly, it is possible to reliably determine the position of the chain cover in a height direction (the first direction) with respect to the internal combustion engine main body in the vicinity of the second sealing member, and it is possible to prevent an unexpected external force or vibration of the internal combustion engine main body from shaking the chain cover that is disposed separately from the internal combustion engine main body by the first gap.

In the configuration in which the internal combustion engine further includes the second sealing member, it is preferable that in a state where the chain cover and the oil seal fixing member are assembled to the internal combustion engine main body, a reaction force of the second sealing member against the chain cover is set to be greater than a reaction force of the first sealing member against the chain cover. In this configuration, it is possible to prevent the reaction force of the first sealing member against the chain cover from causing the second sealing member to be excessively squeezed in the first direction in which the first gap decreases. That is, the squeezing of the second sealing member is appropriately maintained, and thus it is possible to keep the sealing function of the second sealing member. As a result, it is possible to reliably prevent oil from leaking to the outside via a gap (the first gap) between the internal combustion engine main body and the chain cover, using the sealing function of the second sealing member. Since the second sealing member is not excessively deformed, it is possible to prevent deterioration of the second sealing member, and thus deterioration in the durability of the second sealing member.

In the internal combustion engine according to the aspect, it is preferable that the internal combustion engine further includes a pin member that is provided in the internal combustion engine main body so as to protrude toward the oil seal fixing member, and the oil seal fixing member includes a positioning hole which is fitted onto the pin member, and thus determines the position of the oil seal fixing member with respect to the internal combustion engine main body. In this configuration, the pin member of the internal combustion engine main body inserted (fitted) into the positioning hole provided in the metallic oil seal fixing member, and thus it is possible to improve the accuracy of the fixing position of the oil seal fixing member with respect to the internal combustion engine main body. As a result, it is possible to maintain a high accuracy of the mounting position of the oil seal with respect to the crankshaft.

In the internal combustion engine according to the aspect, it is preferable that the oil seal fixing member includes a first positioning portion that is brought into contact with the chain cover in a second direction orthogonal to an extending direction of the crankshaft, and thus determines the position of the chain cover with respect to the oil seal fixing member in the second direction. In this configuration, it is possible to appropriately maintain the attachment position of the chain cover with respect to the oil seal fixing member in the second direction (a direction orthogonal to the crankshaft), using the first positioning portion of the oil seal fixing member. Accordingly, it is possible to appropriately maintain a relative positional relationship between the oil seal fixing member and the chain cover in the second direction orthogonal to the crankshaft, the oil seal fixing member and the chain cover facing each other with the first sealing member interposed therebetween. It is possible to prevent an unexpected external force or vibration of the internal combustion engine main body from causing a positional deviation of the chain cover in the second direction.

In the configuration in which the oil seal fixing member includes the first positioning portion, it is preferable that the first positioning portion includes an outer circumferential portion of an attachment boss having an attachment hole for attaching the oil seal fixing member to the internal combustion engine main body. In this configuration, since it is possible to use the outer circumferential portion of the attachment boss of the oil seal fixing member as the first positioning portion that determines the position of the chain cover with respect to the oil seal fixing member in the second direction, it is not necessary to provide the dedicated first positioning portion, and it is possible to simplify the configuration of the oil seal fixing member to that extent.

In this case, it is preferable that the chain cover includes a second positioning portion having an attachment boss fitting hole into which the attachment boss is inserted and fittable, and the first positioning portion having the outer circumferential portion of the attachment boss of the oil seal fixing member and the second positioning portion having the attachment boss fitting hole of the chain cover determine the position of the chain cover with respect to the oil seal fixing member in the second direction. In this configuration, the outer circumferential portion (the first positioning portion) of the attachment boss of the oil seal fixing member is circumferentially fitted into the attachment boss fitting hole (the second positioning portion) of the chain cover, and thus it is possible to easily determine the position of the chain cover with respect to the oil seal fixing member in the second direction. Since the first positioning portion is circumferentially fitted into the second positioning portion, it is possible to improve the accuracy of the positioning of the chain cover with respect to the oil seal fixing member in the second direction orthogonal to the crankshaft.

In the internal combustion engine according to the aspect, it is preferable that the oil seal fixing member includes a second chain cover contact portion that is in contact with the chain cover in the vicinity of the first sealing member and in a state where a second gap is provided between the oil seal fixing member and the chain cover by the first sealing member, the second chain cover contact portion is brought into contact with the chain cover from the oil seal fixing member toward the chain cover in the first direction. In this configuration, it is possible to maintain the second gap between the chain cover and the oil seal fixing member to a constant distance, using the second chain cover contact portion of the oil seal fixing member, and thus it is possible to appropriately maintain the squeezing of the first sealing member provided between the chain cover and the oil seal fixing member. Accordingly, it is possible to stably maintain sealing properties between the chain cover and the oil seal fixing member.

In the internal combustion engine according to the aspect, it is preferable that the chain cover includes an oil seal fixing member engaging portion that is engaged with a portion of the oil seal fixing member in the vicinity of the first sealing member via a crankshaft insertion hole of the oil seal fixing member, the portion being present opposite to the chain cover, and in a state where the second gap is provided between the oil seal fixing member and the chain cover by the first sealing member, the oil seal fixing member engaging portion is brought into contact with the oil seal fixing member from the portion of the oil seal fixing member toward the oil seal fixing member in the first direction, the portion being present opposite to the chain cover. In this configuration, since it is possible to maintain the second gap between the chain cover and the oil seal fixing member to a constant distance, in a state where the chain cover is disposed with respect to the oil seal fixing member in the first direction (toward the internal combustion engine main body), using the oil seal fixing member engaging portion, it is possible to appropriately maintain the squeezing of the first sealing member provided between the chain cover and the oil seal fixing member. Accordingly, it is possible to stably maintain sealing properties between the chain cover and the oil seal fixing member. Since it is possible to easily hold the chain cover in the first direction (toward the internal combustion engine main body) using the oil seal fixing member engaging portion, it is possible to easily prevent an unexpected external force or vibration of the internal combustion engine main body from causing the chain cover to fall off from the oil seal fixing member, the chain cover being disposed separately from the oil seal fixing member by the second gap.

In this case, it is preferable that the oil seal fixing member engaging portion is also brought into contact with an inner surface of the crankshaft insertion hole of the oil seal fixing member, and thus also serves to determine the position of the chain cover with respect to the oil seal fixing member in the second direction orthogonal to the extending direction of the crankshaft. In this configuration, it is possible to appropriately maintain a relative positional relationship between the chain cover and the oil seal fixing member in the second direction orthogonal to the crankshaft, using the oil seal fixing member engaging portion of the chain cover. Accordingly, it is possible to appropriately maintain the relative positional relationship between the chain cover and the oil seal fixing member which face each other with the first sealing member interposed therebetween. It is possible to prevent an unexpected external force or vibration of the internal combustion engine main body from causing a positional deviation of the chain cover in the second direction.

In the internal combustion engine according to the aspect, it is preferable that at least one of the oil seal fixing member and the chain cover includes a circumferential wall that is circumferentially provided so as to surround an overlapping region of the oil seal fixing member and the chain cover when seen from the extending direction of the crankshaft, and protrudes in the first direction in which the oil seal fixing member and the chain cover face each other.

In the internal combustion engine according to an aspect of this disclosure, at least one of the oil seal fixing member and the chain cover includes a circumferential wall that is circumferentially provided so as to surround an overlapping region of the oil seal fixing member and the chain cover when seen from the extending direction of the crankshaft, and protrudes in the first direction in which the oil seal fixing member and the chain cover face each other. Accordingly, it is possible to enclose noise occurring due to vibration of the internal combustion engine main body caused by the rotational operation of the crankshaft or the like, or in particular, noise (operation sound resulting from a meshing operation between a timing chain and a crankshaft timing sprocket, and the like) occurring due to vibration of moving valve system timing members which are disposed in the chain cover and in the vicinity of the crankshaft, inside the circumferential wall that circumferentially surrounds the overlapping region of the oil seal fixing member and the chain cover. That is, the circumferential wall circumferentially provided can prevent noise (radiated sound) of the internal combustion engine main body from leaking (being spread) to the outside. At this time, for example, unlike a case in which vibration energy of the chain cover vibrating together with the internal combustion engine main body is converted into frictional energy (thermal energy), thereby reducing the vibration of the chain cover and noise associated with the vibration, since the internal combustion engine adopts the configuration in which the noise of the internal combustion engine main body is enclosed inside the circumferential wall, using the circumferential wall that does not undergo a change in mechanical properties over time, noise reduction effects do not deteriorate (decrease) over time. As a result, it is possible to maintain effects of reducing noise, which is caused by vibration of the internal combustion engine main body, over a long period of time.

In the internal combustion engine according to the aspect, since it is possible to improve the rigidity of the oil seal fixing member and the chain cover by providing the circumferential wall in at least one of the oil seal fixing member and the chain cover, it is possible to prevent vibration of the internal combustion engine main body from being considerably transmitted to the oil seal fixing member and the chain cover. Accordingly, without being affected by long use of the internal combustion engine, it is possible to reduce a level of noise (radiated sound) that is spread from the internal combustion engine main body to the outside due to vibration of the oil seal fixing member and the chain cover caused by vibration of the internal combustion engine main body.

In the internal combustion engine according to the aspect, it is preferable that a Helmholtz resonator is formed by a space surrounded by the circumferential wall between the oil seal fixing member and the chain cover, and the size of a gap is adjusted in such a manner that the space is set to have a predetermined resonance frequency, the gap being present between a tip of the circumferential wall and a portion of a facing surface of at least one of the oil seal fixing member and the chain cover, the portion facing the tip of the circumferential wall. In this configuration, the space is surrounded by the circumferential wall, and thus the space as the Helmholtz resonator can be easily formed between the oil seal fixing member and the chain cover. Since the size of the gap (a gap between the tip of the circumferential wall and at least one of the respective facing surfaces of the oil seal fixing member and the chain cover) in an inlet portion of the space as the Helmholtz resonator is adjusted in such a manner that the Helmholtz resonator has a resonance frequency (for example, a frequency at a maximum value of radiated sound and neighboring values of the maximum value) to provide sound deadening effects, the space (the Helmholtz resonator) surrounded by the circumferential wall between the oil seal fixing member and the chain cover can effectively cancel out a specific frequency band (a frequency at a maximum value of radiated sound and neighboring values of the maximum value) of noise (radiated sound) occurring due to vibration of the internal combustion engine main body. At this time, since the tip of the circumferential wall is not in contact with the facing surface due to the gap, the oil seal fixing member does not rub against the chain cover (circumferential wall), and the shape of the space as the Helmholtz resonator is maintained. As a result, unlike the case in which vibration energy of the internal combustion engine main body is converted into frictional energy, and thus noise is reduced, it is possible to continuously prevent noise from being spread, using the circumferential wall that does not undergo a change in mechanical properties over time, and it is possible to effectively reduce a level of noise (radiated sound) occurring due to vibration of the internal combustion engine main body, using the space that continues to function as the Helmholtz resonator. The "size of the gap" in this disclosure indicates not only the size of the gap between the tip of the circumferential wall and the facing surface of the oil seal fixing member or the chain cover, the facing surface facing the tip, in one cross section when the oil seal fixing member and the chain cover are disposed so as to face each other, but also, in a broad sense, a circumferential length when the gap surrounds the space (the Helmholtz resonator) circumferentially along the circumferential wall. That is, this is because that Helmholtz resonance occurs based on a ratio of a volume (a volume obtained by multiplying the width, the clearance (the size of the gap), and the circumferential length of the tip of the circumferential wall) between the tip of the circumferential wall and the surface facing the tip, and a space volume (the volume of the Helmholtz resonator).

In the internal combustion engine according to the aspect, it is preferable that the circumferential wall includes a first circumferential wall that extends from the oil seal fixing member toward the chain cover, and a second circumferential wall that is disposed so as to face the first circumferential wall, with a predetermined gap from the first circumferential wall in the second direction orthogonal to the first direction in which the crankshaft extends. In this configuration, it is possible to form the circumferential walls in such a manner that one of the first and second circumferential walls circumferentially surrounds the other of the circumferential walls from the outside in a plan view. That is, since the circumferential wall has at least a dual structure in which the first circumferential wall extends toward the chain cover from the oil seal fixing member, and the second circumferential wall extends toward the oil seal fixing member from the chain cover, it is possible to circumferentially form a labyrinthine structure (a sound shielding structure) in the vicinity of an outer edge portion of the space between the oil seal fixing member and the chain cover. Accordingly, noise occurring in the chain cover due to vibration of the internal combustion engine main body can be further prevented from leaking to the outside of the internal combustion engine main body.

In the internal combustion engine according to the aspect, it is preferable that the internal combustion engine further includes a sound absorbing member that is provided in the space surrounded by the circumferential wall between the oil seal fixing member and the chain cover. In this configuration, it is possible to absorb noise (radiated sound) caused by vibration of the internal combustion engine main body, using the sound absorbing member in the space surrounded by the circumferential wall between the oil seal fixing member and the chain cover. Accordingly, even at this time, it is possible to continuously prevent noise from being spread, using the circumferential wall that does not undergo a change in mechanical properties over time, and it is possible to continuously obtain noise reduction effects, using the sound absorbing member for the absorption of noise. As a result, it is possible to more effectively prevent noise (radiated sound) occurring due to vibration of the internal combustion engine main body.

In this disclosure, the internal combustion engine according to the aspect may have the following configuration.

That is, in the internal combustion engine according to the aspect, the chain cover is made of resin. In this configuration, even when the resin-made chain cover having a relatively large coefficient of thermal expansion and being likely to undergo a positional deviation due to thermal strain is attached to the internal combustion engine main body, it is possible to secure the accuracy of the mounting position of the oil seal with respect to the crankshaft, using the metallic oil seal fixing member. Even when the chain cover is likely to undergo a positional deviation due to thermal strain, oil is securely sealed by the first sealing member interposed between the chain cover and the oil sealing fixing member, and thus it is possible to easily reduce the weight of the internal combustion engine, using the resin-made chain cover.

According to the aspect of this closure, as described above, even when an oil seal is mounted on a crankshaft via an oil seal fixing member formed separately from a chain cover, it is possible to provide an internal combustion engine and the structure of the chain cover of the internal combustion engine in which sealing properties between the chain cover and the oil seal fixing member can be secured.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An internal combustion engine comprising:

a chain cover that is attached to an internal combustion engine main body having a crankshaft;

an oil seal that is mounted on the crankshaft in the vicinity of the chain cover;

a metallic oil seal fixing member that is disposed on a surface of the chain cover and fixes the oil seal, the surface being present opposite to the internal combustion engine main body;

a first sealing member that is disposed between the oil sealing fixing member and the chain cover;

a second sealing member that is disposed between the chain cover and the internal combustion engine main body;

wherein the oil seal fixing member includes a first chain cover contact portion that is in contact with the chain cover in a vicinity of the second sealing member, and wherein in a state where a first gap is provided between the chain cover and the internal combustion engine main body by the second sealing member, the first chain cover contact portion is brought into contact with the chain cover from the oil seal fixing member toward the chain cover in a first direction.

2. The internal combustion engine according to claim 1, wherein in a state where the chain cover and the oil seal fixing member are assembled to the internal combustion engine main body, a reaction force of the second sealing member against the chain cover is set to be greater than a reaction force of the first sealing member against the chain cover.

3. The internal combustion engine according to claim 1, further comprising:

a pin member that is provided in the internal combustion engine main body so as to protrude toward the oil seal fixing member, wherein the oil seal fixing member includes a positioning hole which is fitted onto the pin member, and thus determines the position of the oil seal fixing member with respect to the internal combustion engine main body.

4. The internal combustion engine according to claim 1, wherein the oil seal fixing member includes a first positioning portion that is brought into contact with the chain cover in a second direction orthogonal to an extending direction of the crankshaft, and thus determines the position of the chain cover with respect to the oil seal fixing member in the second direction.

5. The internal combustion engine according to claim 4, wherein the first positioning portion includes an outer circumferential portion of an attachment boss having an attachment hole for attaching the oil seal fixing member to the internal combustion engine main body.

6. The internal combustion engine according to claim 5, wherein the chain cover includes a second positioning portion having an attachment boss fitting hole into which the attachment boss is inserted and fittable, and wherein the first positioning portion having the outer circumferential portion of the attachment boss of the oil seal fixing member, and the second positioning portion having the attachment boss fitting hole of the chain cover determine the position of the chain cover with respect to the oil seal fixing member in the second direction.

7. The internal combustion engine according to claim 1, wherein the oil seal fixing member includes a second chain cover contact portion that is in contact with the chain cover in the vicinity of the first sealing member, and wherein in a state where a second gap is provided between the oil seal fixing member and the chain cover by the first sealing member, the second chain cover contact portion is brought into contact with the chain cover from the oil seal fixing member toward the chain cover in the first direction.

8. The internal combustion engine according to claim 1, wherein the chain cover includes an oil seal fixing member engaging portion that is engaged with a portion of the oil seal fixing member in the vicinity of the first sealing member via a crankshaft insertion hole of the oil seal fixing member, the portion being present opposite to the chain cover, and wherein in a state where the second gap is provided between the oil seal fixing member and the chain cover by the first sealing member, the oil seal fixing member engaging portion is brought into contact with the oil seal fixing member from the portion of the oil seal fixing member toward the oil seal fixing member in the first direction, the portion being present opposite to the chain cover.

9. The internal combustion engine according to claim 8, wherein the oil seal fixing member engaging portion is also brought into contact with an inner surface of the crankshaft insertion hole of the oil seal fixing member, and thus also serves to determine the position of the chain cover with respect to the oil seal fixing member in the second direction orthogonal to the extending direction of the crankshaft.

10. The internal combustion engine according to claim 1, wherein at least one of the oil seal fixing member and the chain cover includes a circumferential wall that is circumferentially provided so as to surround an overlapping region of the oil seal fixing member and the chain cover when seen from the extending direction of the crankshaft, and protrudes in the first direction in which the oil seal fixing member and the chain cover face each other.

11. The internal combustion engine according to claim 10, wherein a Helmholtz resonator is formed by a space surrounded by the circumferential wall between the oil seal fixing member and the chain cover, and the size of a gap is adjusted in such a manner that the space is set to have a predetermined resonance frequency, the gap being present between a tip of the circumferential wall and a portion of a facing surface of at least one of the oil seal fixing member and the chain cover, the portion facing the tip of the circumferential wall.

12. The internal combustion engine according to claim 10, wherein the circumferential wall includes a first circumferential wall that extends from the oil seal fixing member toward the chain cover, and a second circumferential wall that is disposed so as to face the first circumferential wall, with a predetermined gap from the first circumferential wall in the second direction orthogonal to the first direction in which the crankshaft extends and that extends from the chain cover toward the oil seal fixing member.

13. The internal combustion engine according to claim 10, further comprising:

a sound absorbing member that is provided in the space surrounded by the circumferential wall between the oil seal fixing member and the chain cover.

* * * * *